US011429055B2

(12) United States Patent
Watanabe et al.

(10) Patent No.: US 11,429,055 B2
(45) Date of Patent: Aug. 30, 2022

(54) METAL FRAME OF IMAGE FORMING APPARATUS AND IMAGE FORMING APPARATUS

(71) Applicant: CANON KABUSHIKI KAISHA, Tokyo (JP)

(72) Inventors: Tatsuhito Watanabe, Tokyo (JP); Takahiro Kobayashi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/004,564

(22) Filed: Aug. 27, 2020

(65) Prior Publication Data

US 2021/0063946 A1 Mar. 4, 2021

(30) Foreign Application Priority Data

Aug. 30, 2019 (JP) ..... JP2019-158414

(51) Int. Cl.
*G03G 15/00* (2006.01)
*G03G 21/16* (2006.01)

(52) U.S. Cl.
CPC ..... *G03G 21/1619* (2013.01); *G03G 21/1633* (2013.01); *G03G 21/1642* (2013.01); *G03G 2221/1678* (2013.01)

(58) Field of Classification Search
CPC ..... G03G 15/605; G03G 21/1619; G03G 21/1633; G03G 2221/1678
See application file for complete search history.

(56) References Cited

U.S. PATENT DOCUMENTS 9,188,935 B2 * 11/2015 Nishimura ..... G03G 21/1652
9,261,853 B2 * 2/2016 Souda ..... G03G 21/1853
(Continued)

FOREIGN PATENT DOCUMENTS

JP 2008-116619 A 5/2008

OTHER PUBLICATIONS

U.S. Appl. No. 17/004,488, filed Aug. 27, 2020.
U.S. Appl. No. 17/004,464, filed Aug. 27, 2020.
U.S. Appl. No. 17/004,529, filed Aug. 27, 2020.

*Primary Examiner* — Hoang X Ngo
(74) *Attorney, Agent, or Firm* — Venable LLP

(57) ABSTRACT

A metal frame of an image forming apparatus includes a connecting member which is a metal plate and which connects first and second spaced apart support members which are constructed to support an image forming unit of the an image forming apparatus. The connecting member includes a first facing portion which faces a first region of the first support member around a slit portion thereof, and a fitted portion which is supported by an inner peripheral surface of the slit portion and is fitted into the slit portion in a plate thickness direction of the fitted portion. A width of the fitted portion in a direction vertical to a plate thickness direction of the first support member and the plate thickness direction of the fitted portion in the slit portion is less than or equal to a width of the slit portion in the vertical direction. The fitted portion includes a hook portion having a hook shape and a second facing portion which faces a second region which is provided on a rear surface of a surface of the first support member on which the first region is provided, and which is adjacent to the slit portion in the vertical direction with a gap.

14 Claims, 31 Drawing Sheets

(56) References Cited

U.S. PATENT DOCUMENTS

| | | | | |
|---|---|---|---|---|
| 9,442,458 | B2 | 9/2016 | Kobayashi et al. | G03G 21/1647 |
| 10,775,733 | B2 | 9/2020 | Kobayashi et al. | B41J 29/02 |
| 2012/0219316 | A1* | 8/2012 | Souda | G03G 21/1619 399/107 |
| 2013/0287432 | A1* | 10/2013 | Ikeda | G03G 15/605 399/107 |
| 2020/0094302 | A1 | 3/2020 | Yahagi et al. | B21D 5/01 |

* cited by examiner 53
53a
53c
L12
L13
65
65a
65a1
65a1x
65a2
65a2x
65a3
L9
L10
L11
65b
65b1
65b1x
65b2
65b2x
65b3
X
Y
Z

METAL FRAME OF IMAGE FORMING APPARATUS AND IMAGE FORMING APPARATUS

BACKGROUND OF THE INVENTION

Field of the Invention

The present invention relates to a metal frame of an image forming apparatus such as an electrophotographic copying machine and an electrophotographic printer (for example, a laser beam printer or a light emitting diode (LED) printer), and an image forming apparatus.

Description of the Related Art

A frame of an image forming apparatus is generally formed by joining a plurality of sheet metals such as a front side plate, a rear side plate, and a stay connecting between the front side plate and the rear side plate to each other by welding or the like. By joining such sheet metals to each other in a state where they are assembled to each other with high position accuracy, position accuracy between respective members supported by the frame is maintained, such that it becomes possible to form a high-quality image.

Meanwhile, Japanese Patent Application Laid-Open No. 2008-116619 describes a configuration for assembling a first sheet metal and a second sheet metal, which are sheet metals constituting a frame of an image forming apparatus, to each other with high position accuracy. The configuration described in Japanese Patent Application Laid-Open No. 2008-116619 is a configuration in which a protrusion portion formed on the first sheet metal is inserted into an opening portion formed in the second sheet metal to assemble the first sheet metal and the second sheet metal to each other. A first bulging portion that abuts on one surface of the protrusion portion of the first sheet metal in a plate thickness direction and a second bulging portion that abuts on the other surface of the first sheet metal in the plate thickness direction are formed inside the opening portion of the second sheet metal. By nipping the protrusion portion from the plate thickness direction by the first bulging portion and the second bulging portion, a position of the first sheet metal with respect to the second sheet metal in the plate thickness direction is determined. In addition, in a direction orthogonal to an insertion direction of the first sheet metal into the second sheet metal and the plate thickness direction of the first sheet metal, by making a width of the opening portion and a width of the protrusion portion substantially the same as each other, a position of the first sheet metal with respect to the second sheet metal in the orthogonal direction is determined.

However, in the configuration described in Japanese Patent Application Laid-Open No. 2008-116619, a portion that restricts movement of the first sheet metal with respect to the second sheet metal in a direction opposite to the insertion direction is not provided. Therefore, in a case where an unintended force is applied to the first sheet metal or the second sheet metal in a state where the first sheet metal is assembled to the second sheet metal, there is a possibility that the first sheet metal will move with respect to the second sheet metal in the direction opposite to the insertion direction, such that the first sheet metal and the second sheet metal are separated from each other, resulting in deterioration of position accuracy.

SUMMARY OF THE INVENTION

It is desirable to provide a metal frame of an image forming apparatus capable of preventing sheet metals constituting a frame from being separated from each other to deteriorate position accuracy.

According to an aspect of the present invention, a metal frame of an image forming apparatus including an image forming unit which forms an image on a sheet includes:

- a first support member which is a sheet plate supporting the image forming unit and has a slit portion formed therein, the slit portion being a through-hole;
- a second support member which is arranged with an interval from the first support member and supports the image forming unit together with the first support member; and
- a beam member which is a sheet metal connecting the first support member and the second support member to each other, wherein the beam member includes:

- a facing portion which faces a first region of the first support member around the slit portion; and
- a fitted portion which is supported by an inner peripheral end surface of the slit portion and is fitted into the slit portion in a plate thickness direction of the fitted portion, wherein a width of the fitted portion in a direction vertical to a plate thickness direction of the first support member and the plate thickness direction of the fitted portion in the slit portion is less than or equal to a width of the slit portion in the vertical direction, and wherein the fitted portion includes a hook portion which is provided on a rear surface of a surface of the first support member on which the first region is provided, includes an end surface of the beam member facing a second region of the first support member adjacent to the slit portion in the vertical direction, with a gap, and has a hook shape.

Further features of the present invention will become apparent from the following description of exemplary embodiments with reference to the attached drawings.

DESCRIPTION OF THE EMBODIMENTS

First Embodiment

<Image Forming Apparatus>

Hereinafter, first, an overall configuration of an image forming apparatus according to a first embodiment of the present invention will be described with reference to the drawings, together with an operation at the time of image formation. Note that dimensions, materials, shapes, relative arrangements, and the like of components described below are not intended to limit the scope of the present invention unless specifically stated otherwise.

An image forming apparatus A according to the present embodiment is an intermediate tandem type electrophotographic image forming apparatus that transfers toners of four colors of yellow Y, magenta M, cyan C, and black K to an intermediate transfer belt, and then transfers an image to a sheet to form the image. Note in the following description, Y, M, C, and K are added as subscripts to members using the toners of the respective colors, but since configurations or operations of the respective members are substantially the same as each other except that colors of the toners used in the respective members are different from each other, the subscripts are appropriately omitted unless it is necessary to distinguish the configurations or the operations of the respective members from each other.

Figure 1:
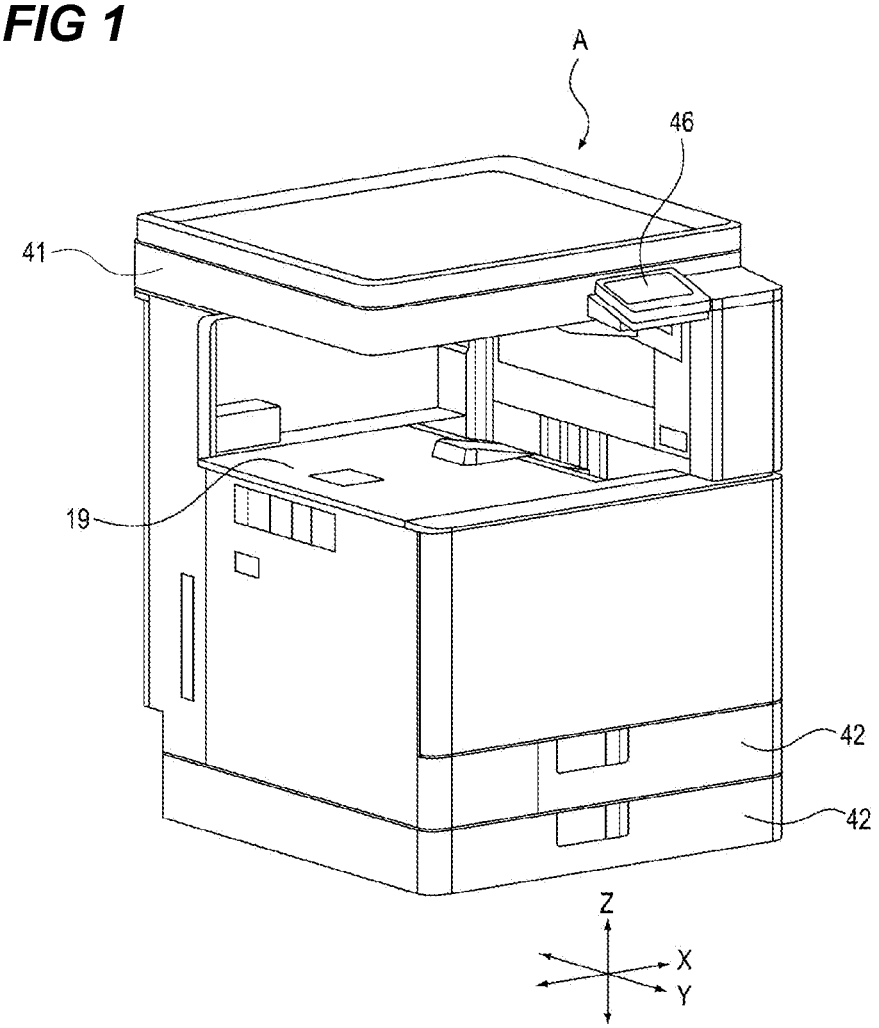
FIG. 1 is a schematic perspective view of an image forming apparatus.
Figure 2:
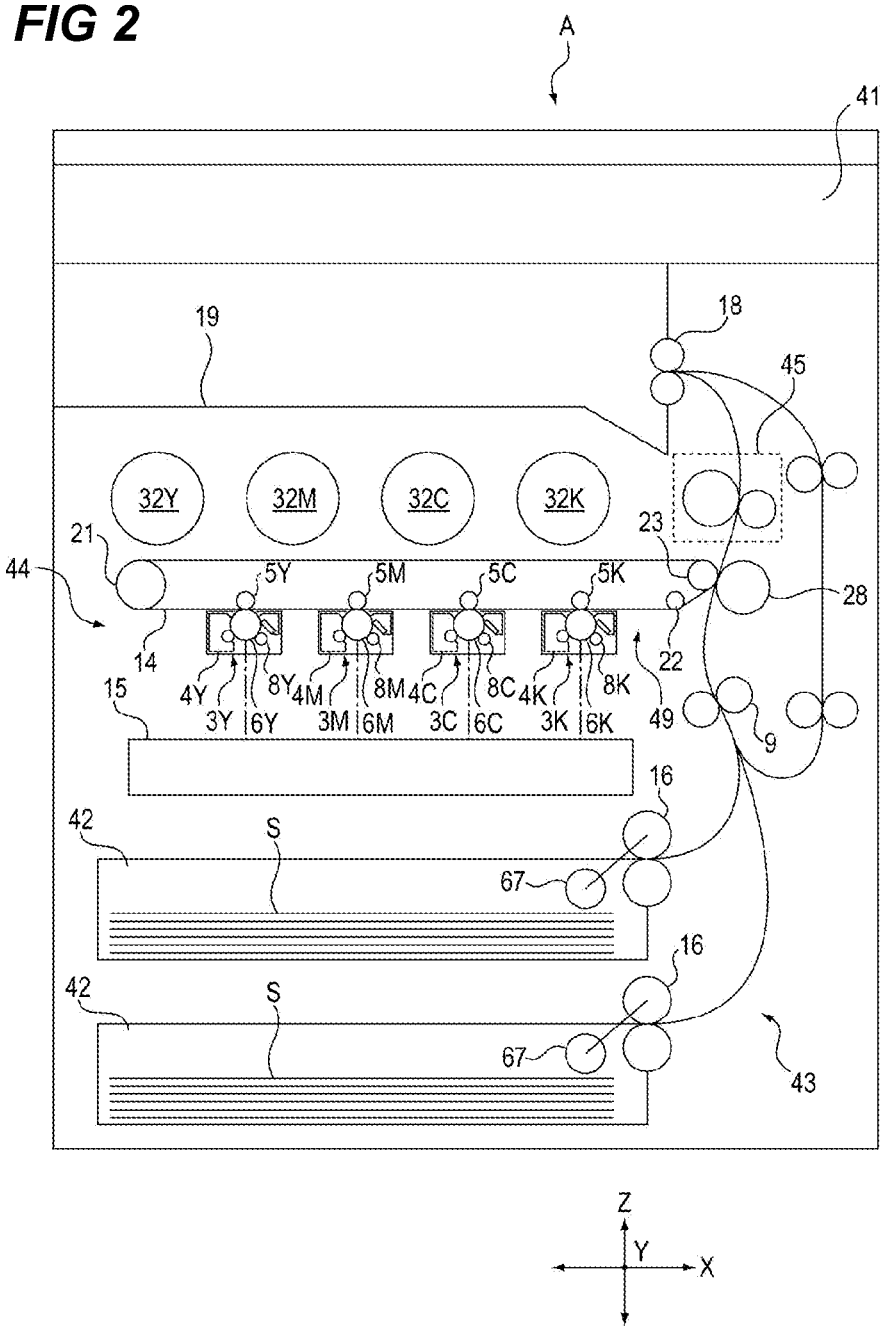
FIG. 2 is a schematic cross-sectional view of the image forming apparatus.

FIG. 1 is a schematic perspective view of an image forming apparatus A. FIG. 2 is a schematic cross-sectional view of the image forming apparatus A. As illustrated in FIGS. 1 and 2, the image forming apparatus A includes an image forming portion 44 that forms a toner image and transfers the toner image to a sheet, a sheet feeding portion 43 that feeds the sheet toward the image forming portion 44, and a fixing portion 45 that fixes the toner image to the sheet. In addition, an image reading portion 41 that reads an image of an original is provided at an upper portion of the image forming apparatus A.

The image forming portion 44 includes a process cartridge 3: 3Y, 3M, 3C, and 3K, a laser scanner unit 15, and an intermediate transfer unit 49. The process cartridge 3 is configured to be detachably attachable to the image forming apparatus A, and includes a photosensitive drum 6: 6Y, 6M, 6C, and 6K, a charging roller 8: 8Y, 8M, 8C, and 8K, a developing device 4: 4Y, 4M, 4C, and 4K.

The intermediate transfer unit 49 includes a primary transfer roller 5: 5Y, 5M, 5C, and 5K, an intermediate transfer belt 14, a secondary transfer roller 28, a secondary transfer counter roller 23, a driving roller 21, and a tension roller 22. The intermediate transfer belt 14 is stretched over the secondary transfer counter roller 23, the driving roller 21, and the tension roller 22, the driving roller 21 rotates by a driving force of a motor (not illustrated), and the intermediate transfer belt 14 circularly moves according to the rotation of the driving roller 21.

Next, an image forming operation by the image forming apparatus A will be described. First, when an image forming job signal is input to a controller (not illustrated), a sheet S stacked and stored in a sheet cassette 42 is sent out to a registration roller 9 by a feeding roller 16. Next, the sheet S is sent into a secondary transfer portion including the secondary transfer roller 28 and the secondary transfer counter roller 23 at a predetermined timing by the registration roller 9.

Meanwhile, in the image forming portion, first, a surface of the photosensitive drum 6Y is charged by the charging roller 8Y Then, the laser scanner unit 15 irradiates the surface of the photosensitive drum 6Y with laser light according to an image signal transmitted from an external device (not illustrated) or the like to form an electrostatic latent image on the surface of the photosensitive drum 6Y.

Then, a yellow toner is attached to the electrostatic latent image formed on the surface of the photosensitive drum 6Y by the developing device 4Y to form a yellow toner image on the surface of the photosensitive drum 6Y The toner image formed on the surface of the photosensitive drum 6Y is primarily transferred to the intermediate transfer belt 14 by applying a bias to the primary transfer roller 5Y.

Magenta, cyan, and black toner images are also formed on the photosensitive drums 6M, 6C, and 6K by a similar process. These toner images are transferred in a superimposed manner onto the yellow toner image on the intermediate transfer belt 14 by applying a primary transfer bias to the primary transfer rollers 5M, 5C, and 5K. As a result, a full-color toner image is formed on a surface of the intermediate transfer belt 14.

Note that when the toner inside the developing device 4 is used by the developing process described above, such that an amount of toner inside the developing device 4 decreases, each developing device 4 is replenished with a toner of each color by a toner bottle 32: 32Y, 32M, 32C, and 32K. The toner bottle 32 is configured to be detachably attachable to the image forming apparatus A.

Then, the intermediate transfer belt 14 circularly moves, such that a full-color toner image is sent to the secondary transfer portion. The full-color toner image on the intermediate transfer belt 14 is transferred to the sheet S by applying a bias to the secondary transfer roller 28 in the secondary transfer portion.

Then, the sheet S to which the toner image is transferred is subjected to heating and pressuring processing in the fixing portion 45, such that the toner image on the sheet S is fixed to the sheet S. Then, the sheet S to which the toner image is fixed is discharged to a discharge portion 19 by a discharge roller 18.

<Frame of Image Forming Apparatus>

Next, a frame 31 of the image forming apparatus A will be described.

Figure 3:
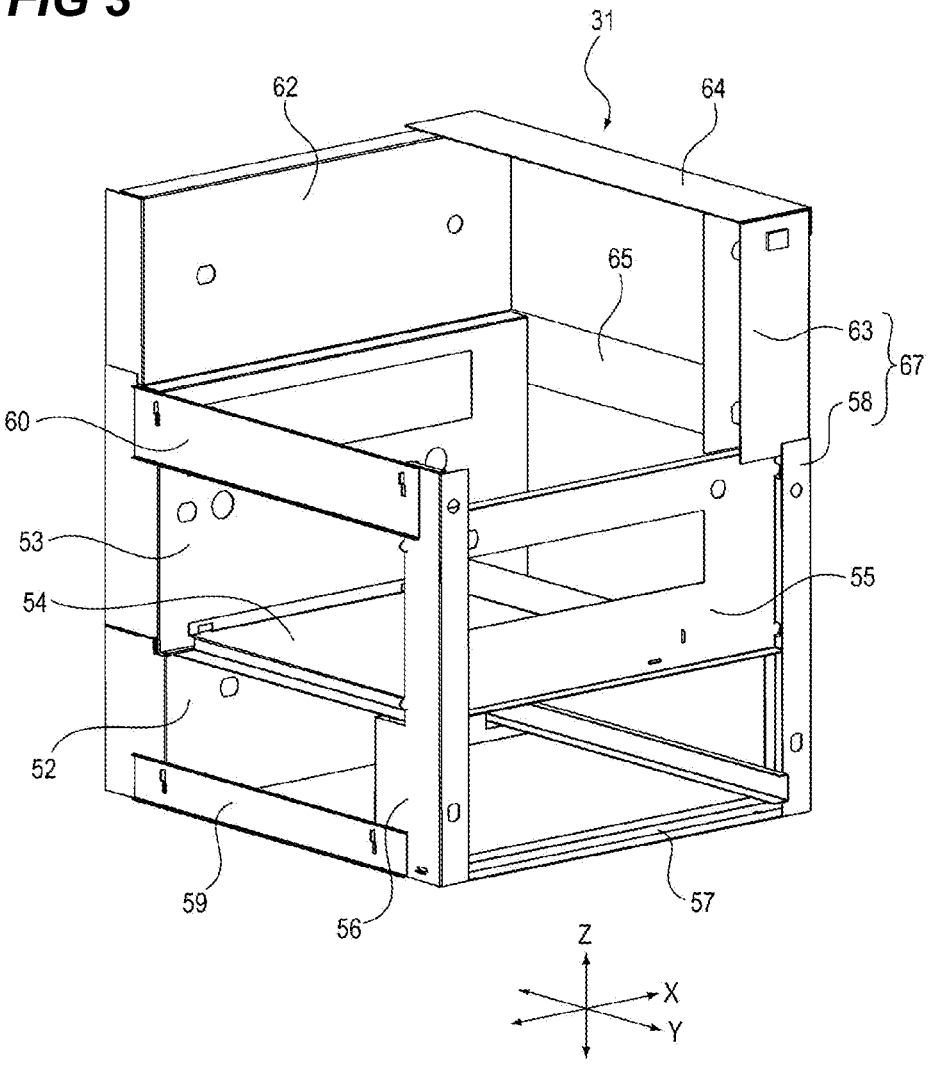
FIG. 3 is a perspective view of a frame of the image forming apparatus.
Figure 4:
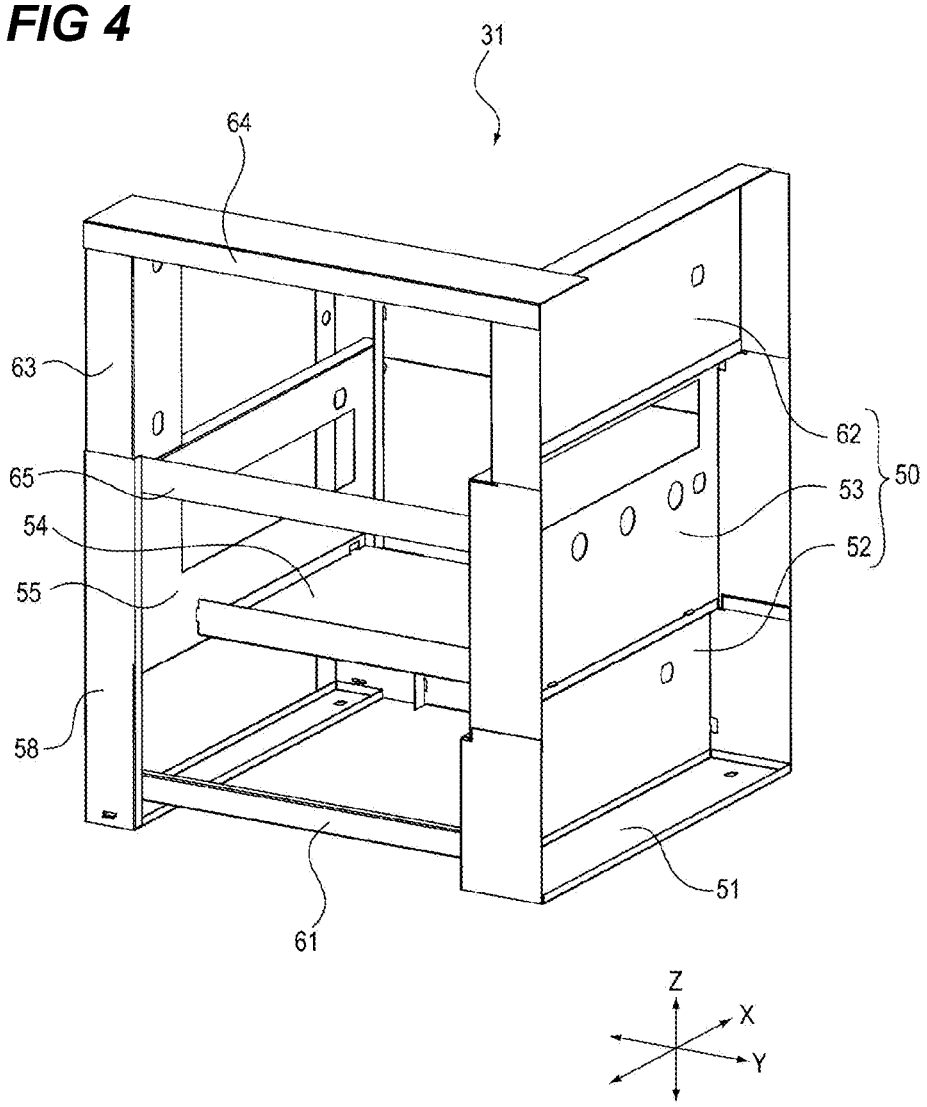
FIG. 4 is a perspective view of the frame of the image forming apparatus.

FIG. 3 is a perspective view of the frame 31 of the image forming apparatus A when viewed from a front surface side of the image forming apparatus A, and is a perspective view of a state where an internal unit such as an image forming unit or an exterior cover is removed. FIG. 4 is a perspective view of the frame 31 of the image forming apparatus A when viewed from a rear surface side of the image forming apparatus A. Note that an arrow X direction illustrated in the drawings is a horizontal direction and indicates a left and right direction of the image forming apparatus A. In addition, an arrow Y direction is a horizontal direction and indicates a front and rear direction of the image forming apparatus A. In addition, an arrow Z direction is a vertical direction and indicates an up and down direction of the image forming apparatus A. In addition, a front side of the image forming apparatus A is a side on which a user normally stands in order to operate an operation portion 46 for performing a setting regarding image formation, and a rear side of the image forming apparatus A is a side opposite to the front side across the frame 31. In addition, a left side of the image forming apparatus A is a left side when viewed from the front side, and a right side of the image forming apparatus A is a right side when viewed from the front side. In addition, the front side of the image forming apparatus A is a direction in which the sheet cassette 42 is pulled out from the image forming apparatus A when the sheet cassette 42 is replenished with sheets, and is a direction in which the toner bottle 32 is pulled out when the toner bottle 32 is replaced.

As illustrated in FIGS. 3 and 4, the image forming apparatus A includes a front side plate 55, a left support column 56, and a right support column 67 that are formed of a sheet metal, as the frame 31 on a front surface side thereof. The left support column 56 is connected to an end portion of one side of the front side plate 55 in the arrow X direction. The right support column 67 is connected to an end portion of the other side of the front side plate 55 in the arrow X direction. In addition, the right support column 67 includes a right support column 58 (lower right support column) and a right support column 63 (upper right support column) connected to an upper portion of the right support column 58 in the vertical direction. The left support column 56 and the right support column 58 are connected to each other by a front lower stay 57.

In addition, the image forming apparatus A includes a rear side plate 50 formed of a sheet metal, as the frame 31 on a rear surface side thereof. The rear side plate 50 is arranged to face the front side plate 55, and supports the process cartridge 3 together with the front side plate 55. The rear side plate 50 is trisected into rear side plates 52, 53, and 62 in the vertical direction, the rear side plate 53 (middle rear side plate) is connected to an upper portion of the rear side plate 52 (lower rear side plate) in the vertical direction, and the rear side plate 62 (upper rear side plate) is connected to an upper portion of the rear side plate 53 in the vertical direction. In addition, a plate thickness of a sheet metal of each of the rear side plates 52, 53, and 62 is about 0.6 mm to 2 mm. In addition, a rear bottom plate 51 is provided below the rear side plate 52.

In addition, the image forming apparatus A includes a left lower stay 59, a left upper stay 60, a right lower stay 61, a right middle stay 65, a right upper stay 64, and a middle stay 54, as the frame 31 connecting the frame 31 on the front surface side and the frame 31 on the rear surface side to each other. The left lower stay 59 connects the left support column 56 and the rear side plate 52 to each other. The left upper stay 60 connects the left support column 56 and the rear side plate 53 to each other. The right lower stay 61 connects the right support column 58 and the rear side plate 52 to each other. The right middle stay 65 connects the rear side plate 53 and the right support column 58 to each other. The right upper stay 64 connects the right support column 63 and the rear side plate 62 to each other. The middle stay 54 connects the front side plate 55 and the rear side plate 53 to each other.

Note that each of the members constituting the frame 31 described above is formed of one sheet metal. These sheet metals are processed in a predetermined shape by drawing or the like, and then become the frame 31 through an assembling process and a joining process to be described later.

<Frame Assembling Process>

Next, a process of assembling a plurality of sheet metals constituting the frame 31 will be described. FIGS. 5 to 28B are views illustrating aspects where the sheet metals constituting the frame 31 are assembled.

Figure 5:
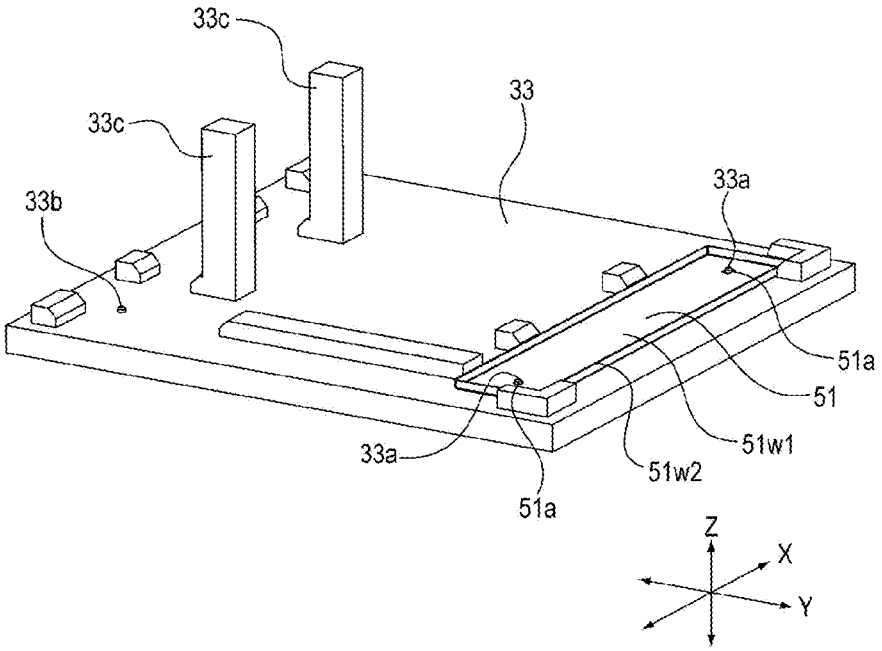
FIG. 5 is a perspective view when a rear bottom plate is assembled.

As illustrated in FIG. 5, a stand 33 is used when the sheet metals constituting the frame 31 are assembled. The stand 33 is provided with positioning pins 33*a* and 33*b* and support columns 33*c*. First, the rear bottom plate 51 is placed on the stand 33. The rear bottom plate 51 includes a flat surface portion 51*w*1 facing the stand 33, and a bent and raised portion 51*w*2 bent and raised from the flat surface portion 51*w*1. The bent and raised portion 51*w*2 is formed at least on a side engaging with the rear side plate 52. When the rear bottom plate 51 is placed on the stand 33, a position of the rear bottom plate 51 with respect to the stand 33 is determined by inserting the positioning pins 33*a* of the stand 33 into positioning holes 51*a* formed in the flat surface portion 51*w*1 of the rear bottom plate 51.

Figure 6A:
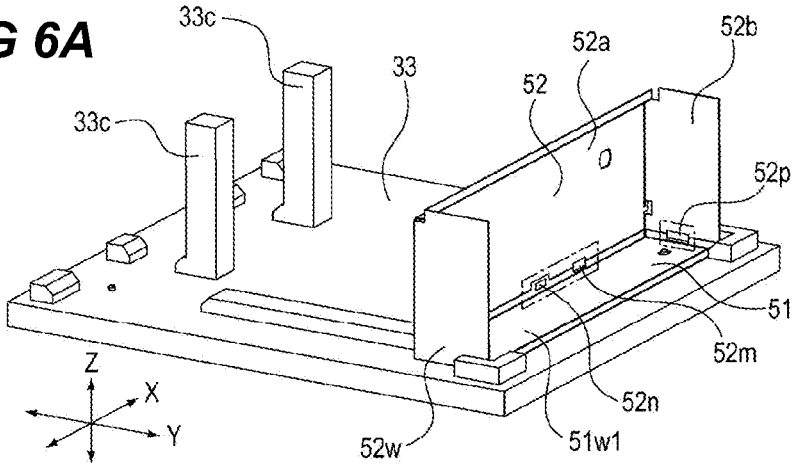
FIGS. 6A to 6C are perspective views when a rear side plate is assembled.
Figure 6B:
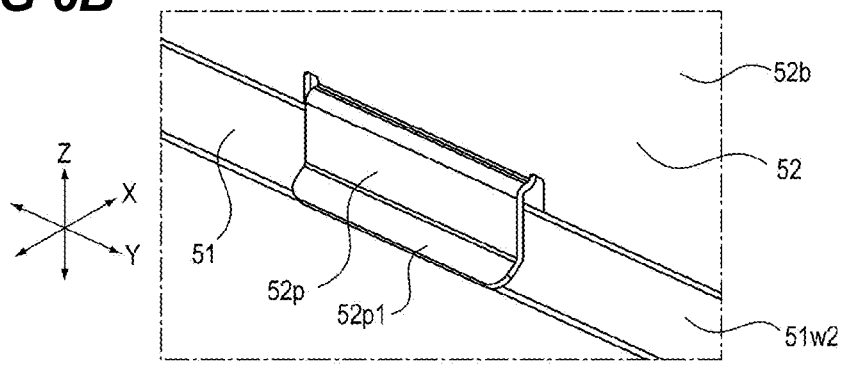
Figure 6C:
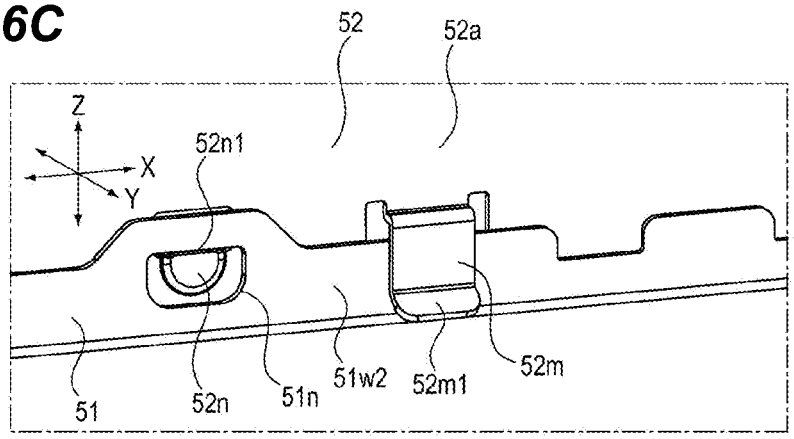

Next, as illustrated in FIGS. 6A to 6C, the rear side plate 52 is assembled. The rear side plate 52 is subjected to bending so as to have a U-shape having three flat surfaces. The rear side plate 52 includes a flat surface portion 52*a* located on a rear surface of the image forming apparatus A, and a bent portion 52*b* bent with respect to the flat surface portion 52*a* and extending rearward of the image forming apparatus A, and a bent portion 52*w* bent with respect to the flat surface portion 52*a* so as to face the bent portion 52*b*. The rear side plate 52 is inserted and assembled into the rear bottom plate 51. A projection portion 52*n* formed so as to protrude by drawing in a plate thickness direction of the flat surface portion 52*a* and a step-bent portion 52*m* are provided at a lower portion of the flat surface portion 52*a* of the rear side plate 52. A step-bent portion 52*p* is provided at a lower portion of the bent portion 52*b* of the rear side plate 52. The step-bent portion 52*m* has a portion bent in the plate thickness direction (arrow Y direction) of the flat surface portion 52*a* and a portion bent and extended from that portion in an insertion direction (arrow Z direction) of the rear side plate 52 into the rear bottom plate 51. The step-bent portion 52*p* has a portion bent in a plate thickness direction (arrow X direction) of the bent portion 52*b* and a portion bent and extended from that portion in the insertion direction of the rear side plate 52 into the rear bottom plate 51. In addition, a tip portion of the step-bent portion 52*m* is an inclined portion 52*m*1 inclined in a direction away from the flat surface portion 52*a* of the rear side plate 52 with respect to the insertion direction of the rear side plate 52 into the rear bottom plate 51. A tip portion of the step-bent portion 52*p* is an inclined portion 52*p*1 inclined in a direction away from the bent portion 52*b* of the rear side plate 52 with respect to the insertion direction of the rear side plate 52 into the rear bottom plate 51. In addition, a through-hole 51*n* penetrating the bent and raised portion 51*w*2 in a plate thickness direction (arrow Y direction) of the bent and raised portion 51*w*2 is formed in the bent and raised portion 51*w*2 of the rear bottom plate 51.

When the rear side plate 52 is inserted and assembled into the rear bottom plate 51 in the insertion direction (arrow Z direction), the step-bent portions 52*m* and 52*p* of the rear side plate 52 are inserted into and engaged with the bent and raised portions 51*w*2 of the rear bottom plate 51. At this time, the inclined portions 52*m*1 and 52*p*1 of the rear side plate 52 abut on the bent and raised portions 51*w*2 of the rear bottom plate 51, such that movement of the rear side plate 52 in the arrow Z direction is guided. As a result, the bent and raised portion 51*w*2 of the rear bottom plate 51 is sandwiched from the plate thickness direction of the band and raised portion 51*w*2 by the step-bent portions 52*m* and 52*p*, and the flat surface portions 52*a* and the bent portion 52*b* in the rear side plate 52, such that a position of the rear side plate 52 with respect to the rear bottom plate 51 in the arrow X direction and the arrow Y direction is determined. In addition, the projection portion 52*n* of the rear side plate 52 engages with the through-hole 51*n* of the rear bottom plate 51. As a result, an edge portion 52*n*1 of the projection portion 52*n* abuts on an inner wall of the through-hole 51*n*, such that movement of the rear side plate 52 with respect to the rear bottom plate 51 in a direction opposite to the insertion direction is restricted. In addition, when the rear side plate 52 is inserted into the rear bottom plate 51 up to a position where a lower end portion of the rear side plate 52 abuts on a surface of the stand 33 on which the rear bottom plate 51 is placed or a position where portions of the step-bent portions 52*m* and 52*p* bent and raised from the flat surface portions 52*a* and the bent portion 52*b* abut on an upper end portion of the bent and raised portion 51*w*2 of the rear bottom plate 51, positions of the rear side plate 52 and the rear bottom plate 51 in the arrow Z direction are determined, such that a final relative position between the rear bottom plate 51 and the rear side plate 52 is determined.

Figure 7:
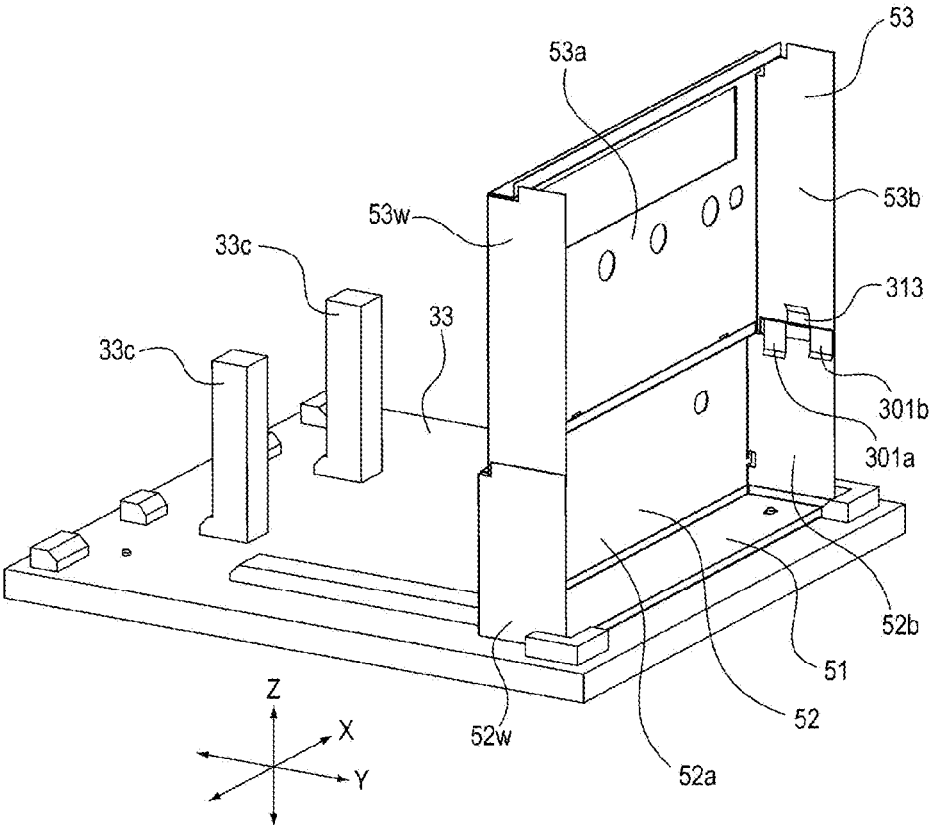
FIG. 7 is a perspective view when a rear side plate is assembled.

Next, as illustrated in FIG. 7, the rear side plate 53 is assembled. The rear side plate 53 supports the process cartridge 3 that has a large influence on image quality at the time of image formation. Therefore, it is particularly desirable that the rear side plate 53 is assembled with high position accuracy. Hereinafter, an assembly configuration of the rear side plate 53 will be described in detail.

As illustrated in FIG. 7, the rear side plate 53 is subjected to bending so as to have three flat surfaces. The rear side plate 53 is located on the rear side of the image forming apparatus A, and includes a support portion 53*a* supporting the process cartridge 3 and a bent portion 53*b* bent at a bending angle of a substantially right angle (89 to 90 degrees) with respect to the support portion 53*a* and extending rearward of the image forming apparatus A. In addition, the rear side plate 53 includes a bent portion 53*w* bent with respect to the support portion 53*a* so as to face the bent portion 53*b*.

The support portion 53*a* of the rear side plate 53 is arranged adjacent to the flat surface portion 52*a* of the rear side plate 52 in the vertical direction, and the support portion 53*a* of the rear side plate 53 and the flat surface portion 52*a* of the rear side plate 52 are inserted and assembled into each other. The bent portion 53*b* of the rear side plate 53 is arranged adjacent to the bent portion 52*b* of the rear side plate 52 in the vertical direction, and the bent portion 53*b* of the rear side plate 53 and the bent portion 52*b* of the rear side plate 52 are inserted and assembled into each other. The bent portion 53*w* of the rear side plate 53 is arranged adjacent to the bent portion 52*w* of the rear side plate 52 in the vertical direction, and the bent portion 53*w* of the rear side plate 53 and the bent portion 52*w* of the rear side plate 52 are inserted and assembled into each other.

Figure 8A:
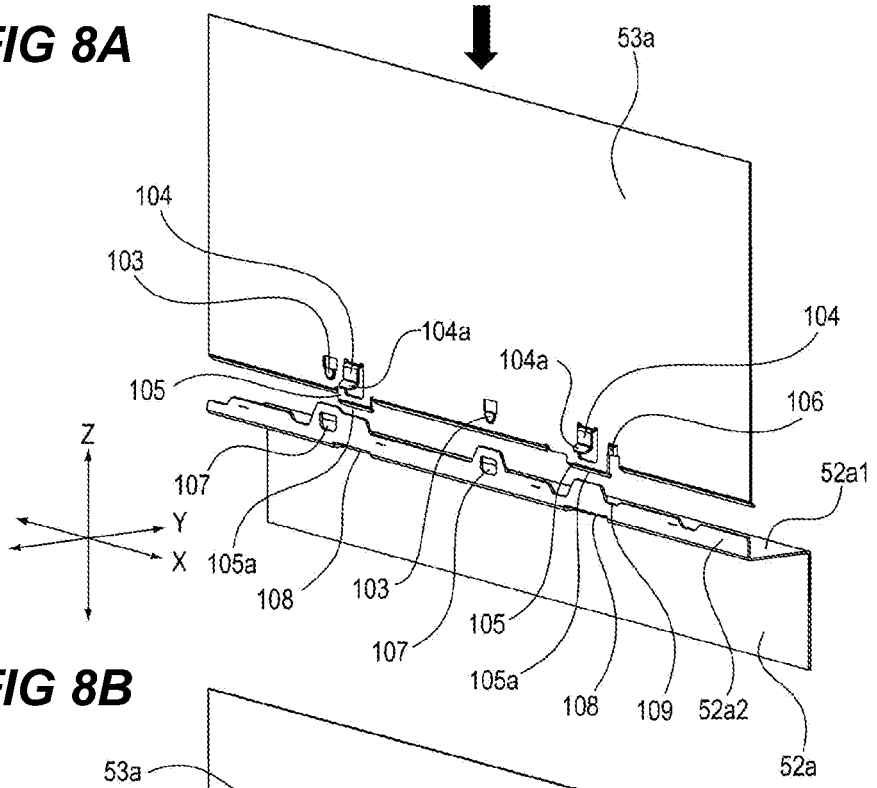
FIGS. 8A and 8B are perspective views of a support portion of the rear side plate.
Figure 8B:
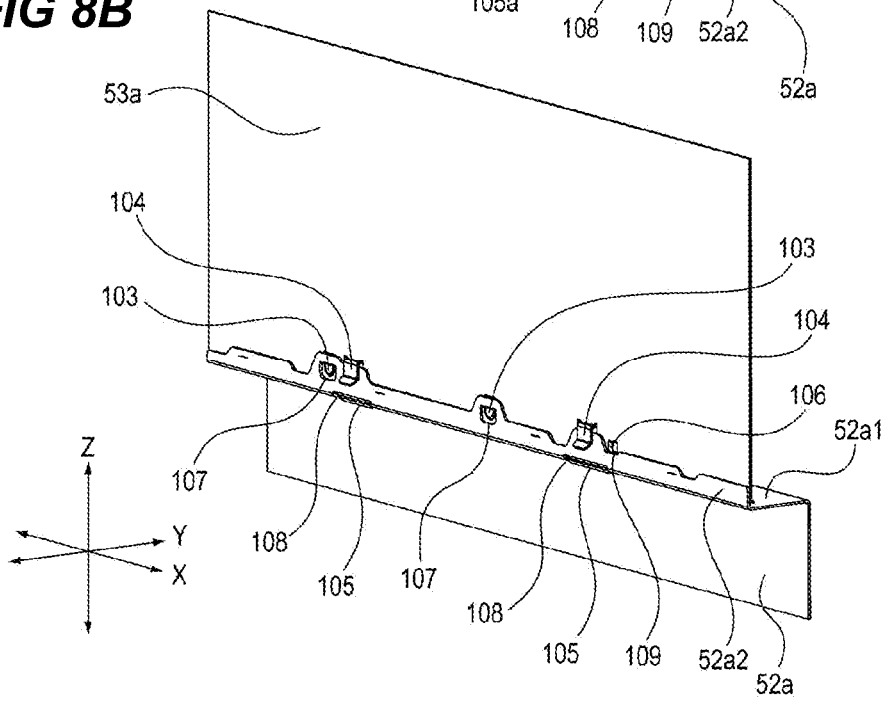

First, an assembly configuration of the flat surface portion 52*a* of the rear side plate 52 and the support portion 53*a* of the rear side plate 53 will be described. FIGS. 8A and 8B are perspective views of the flat surface portion 52*a* of the rear side plate 52 and the support portion 53*a* of the rear side plate 53. Here, FIG. 8A illustrates a state before the rear side plate 52 and the rear side plate 53 are assembled to each other, and FIG. 8B illustrates a state where the rear side plate 52 and the rear side plate 53 are assembled to each other.

As illustrated in FIGS. 8A and 8B, the support portion 53*a* of the rear side plate 53 is provided with two projection portions 103 protruding in a plate thickness direction of the rear side plate 53 and two step-bent portion 104 protruding in an insertion direction (arrow Z direction) of the rear side plate 53 into the rear side plate 52. In addition, two protrusion portions 105 protruding in the insertion direction of the rear side plate 53 into the rear side plate 52 are provided below the two step-bent portions 104.

The projection portion 103 is formed by drawing, and a protrusion amount of the projection portion 103 from a surface of the support portion 53*a* is about 0.3 mm to 2 mm. In addition, the projection portion 103 is arranged at a position adjacent to the step-bent portion 104 in a direction (arrow X direction) orthogonal to the plate thickness direction of the rear side plate 53 and the insertion direction of the rear side plate 53 into the rear side plate 52. In addition, a tip portion of the protrusion portion 105 is an inclined portion 105*a* inclined in a direction away from the support portion 53*a* with respect to the insertion direction of the rear side plate 53 into the rear side plate 52.

The step-bent portion 104 has a portion bent in the plate thickness direction of the rear side plate 53 and a portion bent and extended from that portion in the insertion direction of the rear side plate 53 into the rear side plate 52. In addition, a tip portion of the step-bent portion 104 is an inclined portion 104*a* inclined in a direction away from the support portion 53*a* with respect to the insertion direction of the rear side plate 53 into the rear side plate 52.

A bent portion 52*a*1 bent in the arrow Y direction and a bent and raised portion 52*a*2 bent and raised from the bent portion 52*a*1 in the arrow Z direction are formed at an upper portion of the flat surface portion 52*a* of the rear side plate 52. Two through-holes 107 penetrating the bent and raised portion 52*a*2 in a plate thickness direction (arrow Y direction) of the bent and raised portion 52*a*2 are formed in the bent and raised portion 52*a*2. In addition, through-holes 108 penetrating a boundary portion between the bent portion

52*a*1 and the bent and raised portion 52*a*2 in a plate thickness direction thereof are formed at the boundary portion.

When the rear side plate 53 is assembled to the rear side plate 52, the inclined portion 104*a* of the step-bent portion 104 and the inclined portion 105*a* of the protrusion portion 105 of the rear side plate 53 abut on the bent and raised portion 52*a*2 of the rear side plate 52, such that movement of the rear side plate 53 in the arrow Z direction is guided. In addition, a stopper portion 106 of the rear side plate 53 abuts on an abutting portion 109, which is an upper end portion of the bent and raised portion 52*a*2 of the rear side plate 52, such that movement of the rear side plate 53 with respect to the rear side plate 52 in the insertion direction is restricted.

When the rear side plate 53 is assembled to the rear side plate 52, the step-bent portion 104 of the rear side plate 53 is inserted into and engaged with the bent and raised portion 52*a*2 of the rear side plate 52. As a result, the bent and raised portion 52*a*2 of the rear side plate 52 is sandwiched from the plate thickness direction of the bent and raised portion 52*a*2 by the step-bent portion 104 and the support portion 53*a* in the rear side plate 53, such that a position of the rear side plate 53 with respect to the rear side plate 52 in the arrow Y direction is determined.

In addition, the projection portion 103 of the rear side plate 53 engages with the through-hole 107 of the rear side plate 52. As a result, an edge portion 103*a* of the projection portion 103 abuts on an inner wall of the through-hole 107, such that movement of the rear side plate 53 with respect to the rear side plate 52 in a direction opposite to the insertion direction is restricted.

In addition, the protrusion portion 105 of the rear side plate 53 engages with the through-hole 108 of the rear side plate 52. As a result, the protrusion portion 105 abuts on an inner wall of the through-hole 108, such that movement of the rear side plate 53 respect to the rear side plate 52 in the arrow X direction is restricted.

As described above, the projection portion 52*n* that restricts the movement of the rear side plate 53 with respect to the rear side plate 52 in the direction opposite to the insertion direction is provided in the vicinity of the step-bent portion 104 that engages the rear side plate 52 and the rear side plate 53 with each other. As a result, it is possible to prevent the rear side plate 53 from moving with respect to the rear side plate 52 in the direction opposite to the insertion direction, such that the rear side plate 53 and the rear side plate 52 are separated from each other, resulting in deterioration of position accuracy. Therefore, the rear side plate 53 and the rear side plate 52 that constitute the frame 31 can be assembled to each other with high position accuracy.

Figure 9A:
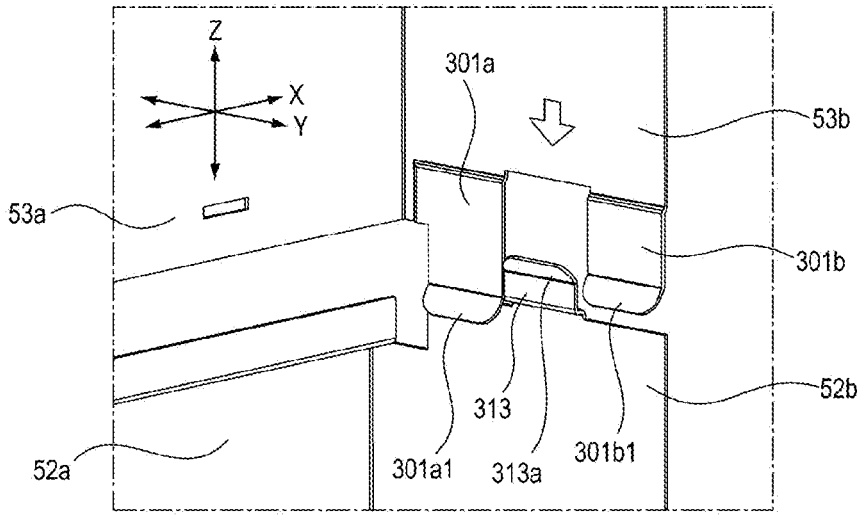
FIGS. 9A and 9B are perspective views of a bent portion of the rear side plate.
Figure 9B:
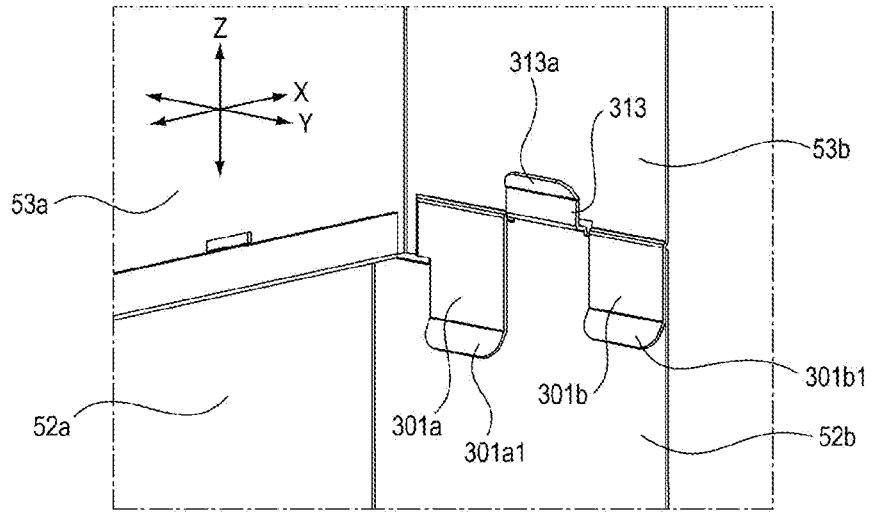

Next, an assembly configuration of the bent portion 52*b* of the rear side plate 52 and the bent portion 53*b* of the rear side plate 53 will be described. FIGS. 9A and 9B are enlarged perspective views of an engaging portion between the bent portion 52*b* of the rear side plate 52 and the bent portion 53*b* of the rear side plate 53. Here, FIG. 9A illustrates a state before the rear side plate 52 and the rear side plate 53 engage with each other, and FIG. 9B illustrates a state in which the rear side plate 52 and the rear side plate 53 engage with each other.

As illustrated in FIGS. 9A and 9B, the bent portion 53*b* of the rear side plate 53 and the bent portion 52*b* of the rear side plate 52 are inserted and assembled into each other. A step-bent portion 313 protruding in an insertion direction (arrow Z direction) into the bent portion 53*b* of the rear side plate 53 and inserted into and engaged with the bent portion 53*b* so as to overlap with the bent portion 53*b* of the rear side plate 53 in a plate thickness direction of the rear side plate 52 is provided at an upper portion of the bent portion 52*b* of the rear side plate 52. The step-bent portion 313 engages with the rear side plate 53 so as to be hooked on a lower end portion of the bent portion 53*b* of the rear side plate 53.

The step-bent portion 313 has a portion bent in the plate thickness direction (arrow X direction) of the bent portion 52*b* of the rear side plate 52 and a portion bent and extended from that portion in the insertion direction into the bent portion 53*b* of the rear side plate 53. In addition, a tip portion of the step-bent portion 313 is an inclined portion 313*a* that is formed to be bent from a portion of the step-bent portion 313 bent in the insertion direction into the bent portion 53*b* of the rear side plate 53 and is inclined in a direction away from the bent portion 52*b* with respect to the insertion direction into the bent portion 53*b*.

In addition, two protrusion portions 301*a* and 301*b* protruding in an insertion direction (arrow Z direction) into the bent portion 52*b* of the rear side plate 52 are provided at a lower portion of the bent portion 53*b* of the rear side plate 53. The protrusion portions 301*a* and 301*b* are inserted into and engaged with the bent portion 52*b* so as to overlap with the bent portion 52*b* of the rear side plate 52 in a plate thickness direction (arrow X direction) of the bent portion 53*b* of the rear side plate 53. In addition, the protrusion portions 301*a* and 301*b* engage with the bent portion 52*b* so as to be hooked on an upper end portion of the bent portion 52*b* of the rear side plate 52. In addition, tip portions of the protrusion portions 301*a* and 301*b* are inclined portions 301*a*1 and 301*b*1 inclined in a direction away from the bent portion 53*b* with respect to the insertion direction into the bent portion 52*b* of the rear side plate 52.

When the step-bent portion 313 engages with the bent portion 53*b* and the protrusion portions 301*a* and 301*b* engage with the bent portion 52*b*, the step-bent portion 313 and the protrusion portions 301*a* and 301*b* alternately perform engagement in a direction (arrow Y direction) orthogonal to the insertion direction and the plate thickness direction of the bent portions 52*b* and 53*b*. Specifically, the protrusion portion 301*a* is inserted into and engaged with the bent portion 52*b* on a side close to the support portion 53*a* of the rear side plate 53 with respect to the step-bent portion 313 and at a position adjacent to the step-bent portion 313, in the orthogonal direction. The protrusion portion 301*b* is inserted into and engaged with the bent portion 52*b* on a side distant from the support portion 53*a* of the rear side plate 53 with respect to the step-bent portion 313 and at a position adjacent to the step-bent portion 313, in the orthogonal direction. With such a configuration, the bent portion 52*b* of the rear side plate 52 and the bent portion 53*b* of the rear side plate 53 are firmly engaged with and assembled to each other.

Figure 10A:
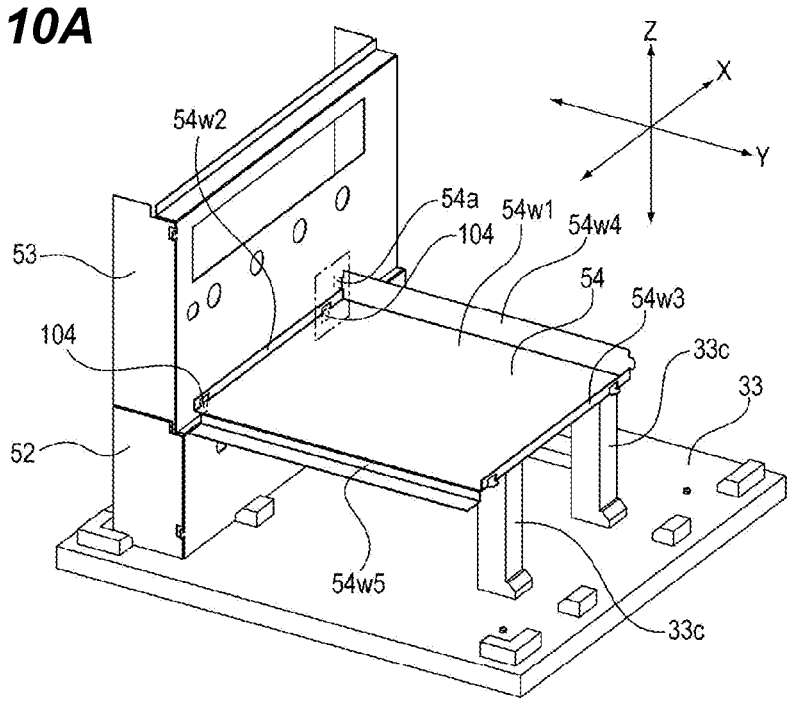
FIGS. 10A and 10B are perspective views when a middle stay is assembled.
Figure 10B:
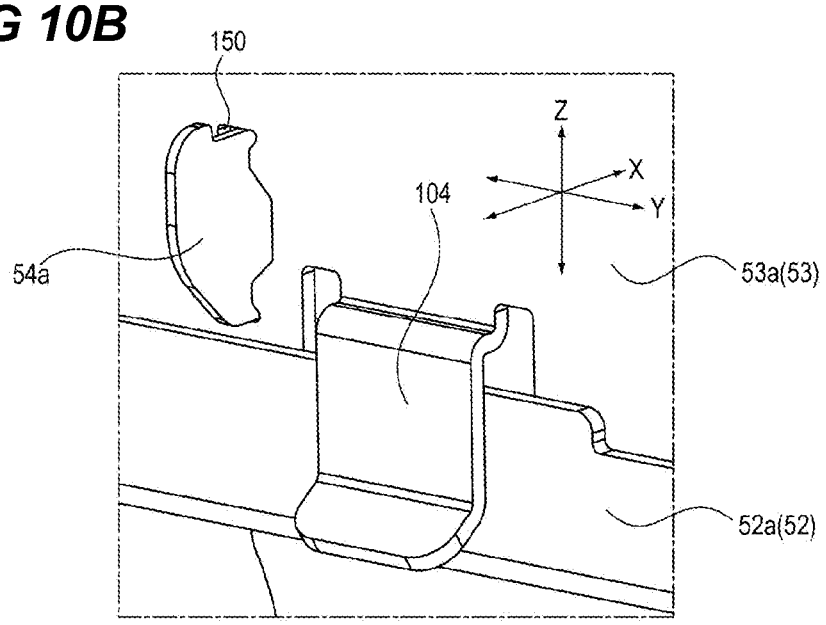

Next, as illustrated in FIGS. 10A and 10B, the middle stay 54 is assembled. The middle stay 54 is an optical stand on which the laser scanner unit 15 is placed. The middle stay 54 is arranged on two support columns 33*c* provided on the stand 33, and is inserted into the support portion 53*a* of the rear side plate 53.

The middle stay 54 has a flat surface portion 54*w*1 extending in the horizontal direction, and a bent and raised portion 54*w*2 bent and raised vertically and upward from the flat surface portion 54*w*1 at one end portion of the flat surface portion 54*w*1 in the arrow Y direction. In addition, the middle stay 54 has a bent and raised portion 54*w*3 bent vertically from the flat surface portion 54*w*1 so as to face the bent and raised portion 54*w*2 and a bent and raised portion 54w4 bent vertically and upward from the flat surface portion 54w1 at one end portion of the flat surface portion 54w1 in the arrow X direction. In addition, the middle stay 54 has a bent portion 54w5 bent vertically and downward from the flat surface portion 54w1 at the other end portion of the flat surface portion 54w1 in the arrow X direction and further extending in the horizontal direction. The bent and raised portion 54w4 of the middle stay 54 is provided with a protrusion portion 54a protruding in an insertion direction (arrow Y direction) into the rear side plate 53. The protrusion portion 54a of the middle stay 54 is inserted into a through-hole 150 formed in the support portion 53a of the rear side plate 53 and penetrating the support portion 53a in a plate thickness direction (arrow Y direction) of the support portion 53a. As a result, a position of the middle stay 54 with respect to the rear side plate 53 in the arrow X direction and the arrow Y direction is determined.

Figure 11A:
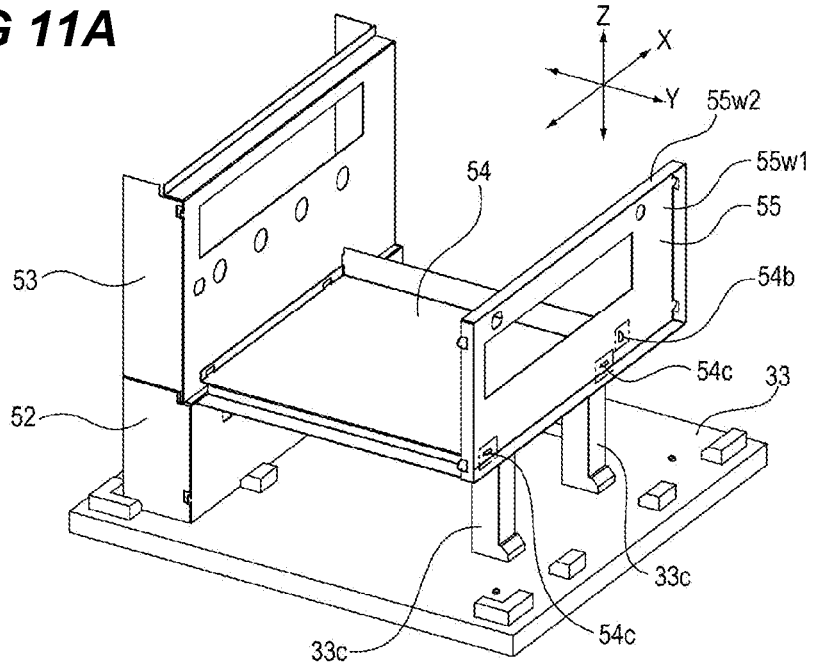
FIGS. 11A to 11C are perspective views when a front side plate is assembled.
Figure 11B:
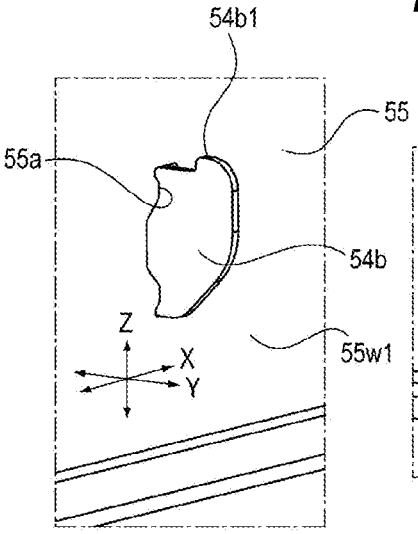
Figure 11C:
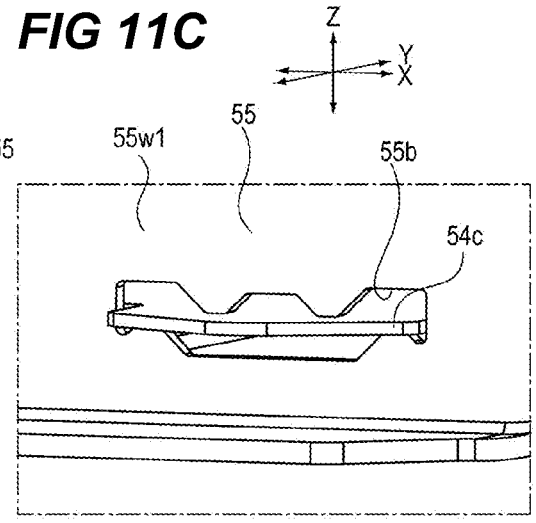

Next, as illustrated in FIGS. 11A to 11C, the front side plate 55 is assembled. The middle stay 54 is inserted into the front side plate 55. The front side plate 55 has a flat surface portion 55w1 extending in the vertical direction and a bent and raised portion 55w2 bent and raised from each of both end portions of the flat surface portion 55w1 in the arrow X direction and the arrow Z direction forward of the image forming apparatus A. Through-holes 55a and 55b penetrating through the flat surface portion 55w1 in a plate thickness direction (arrow Y direction) of the flat surface portion 55w1 are formed in the flat surface portion 55w1 of the front side plate 55. In addition, the bent and raised portion 54w3 of the middle stay 54 is provided with protrusion portions 54b and 54c protruding in an insertion direction (arrow Y direction) into the front side plate 55. A tip portion of the protrusion portion 54b is provided with a hook portion 54b1 protruding upward of a base end portion.

The protrusion portion 54b of the middle stay 54 is inserted into the through-hole 55a formed in the flat surface portion 55w1 of the front side plate 55, and the protrusion portion 54c of the middle stay 54 is inserted into the through-hole 55b formed in the flat surface portion 55w1 of the front side plate 55. As a result, a position of the front side plate 55 with respect to the middle stay 54 is determined. In addition, the hook portion 54b1 of the protrusion portion 54b faces an upper portion of the through-hole 55a in the front side plate 55. As a result, the hook portion 54b1 of the middle stay 54 abuts on the flat surface portion 55w1 of the front side plate 55, such that movement of the middle stay 54 with respect to the front side plate 55 in a direction opposite to the insertion direction is restricted and the middle stay 54 is prevented from coming off.

Figure 12A:
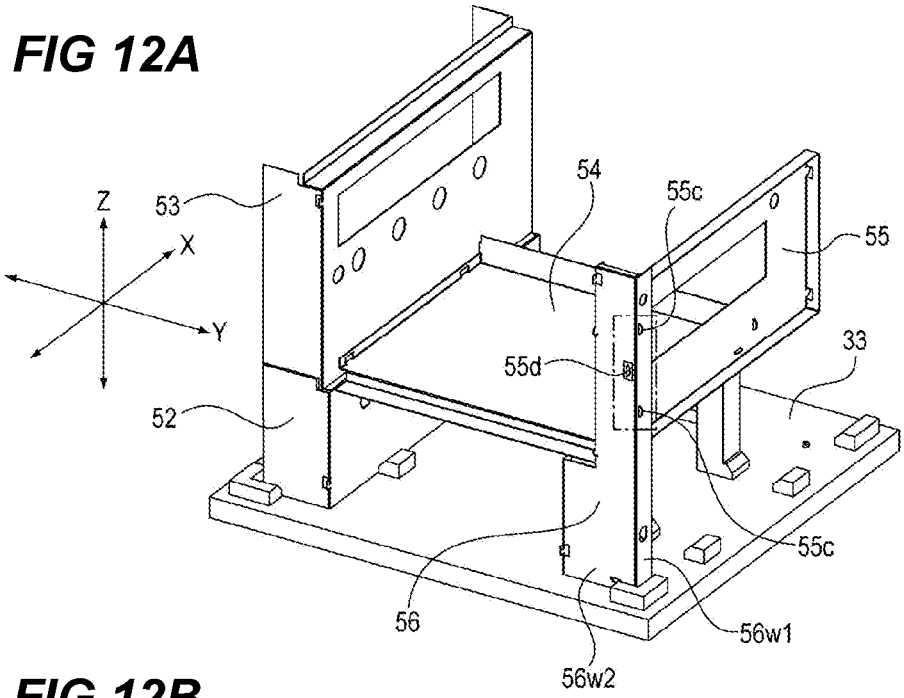
FIGS. 12A and 12B are perspective views when a left support column is assembled.
Figure 12B:
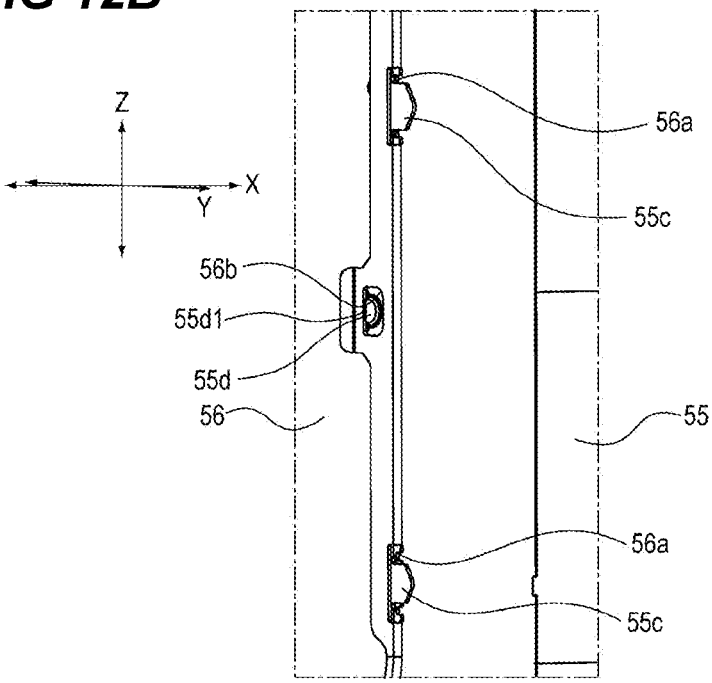

Next, as illustrated in FIGS. 12A and 12B, the left support column 56 is assembled. The left support column 56 is arranged on the stand 33. In addition, the front side plate 55 is inserted into the left support column 56. The left support column 56 is mainly formed of two flat surfaces, and has a flat surface portion 56w1 extending in parallel with the flat surface portion 55w1 of the front side plate 55 and a flat surface portion 56w2 bent substantially vertically from the flat surface portion 56w1 rearward of the image forming apparatus A. A bent portion of a boundary between the flat surface portion 56w1 and the flat surface portion 56w2 of the left support column 56 is provided with through-holes 56a penetrating the bent portion in the arrow Y direction. In addition, the flat surface portion 56w2 of the left support column 56 is provided with a through-hole 56b penetrating the flat surface portion 56w2 in a plate thickness direction (arrow X direction) of the flat surface portion 56w2. In addition, the bent and raised portion 55w2 of the front side plate 55 is provided with protrusion portions 55c protruding in an insertion direction (arrow Y direction) into the left support column 56 and a projection portion 55d protruding in a plate thickness direction (arrow X direction).

The protrusion portion 55c of the front side plate 55 is inserted into the through-hole 56a formed in the left support column 56. As a result, a position of the left support column 56 with respect to the front side plate 55 is determined. In addition, the projection portion 55d of the front side plate 55 engages with the through-hole 56b of the left support column 56. As a result, an edge portion 55d1 of the projection portion 55d abuts on an inner wall of the through-hole 56b, such that movement of the front side plate 55 with respect to the left support column 56 in a direction opposite to the insertion direction is restricted.

Figure 13A:
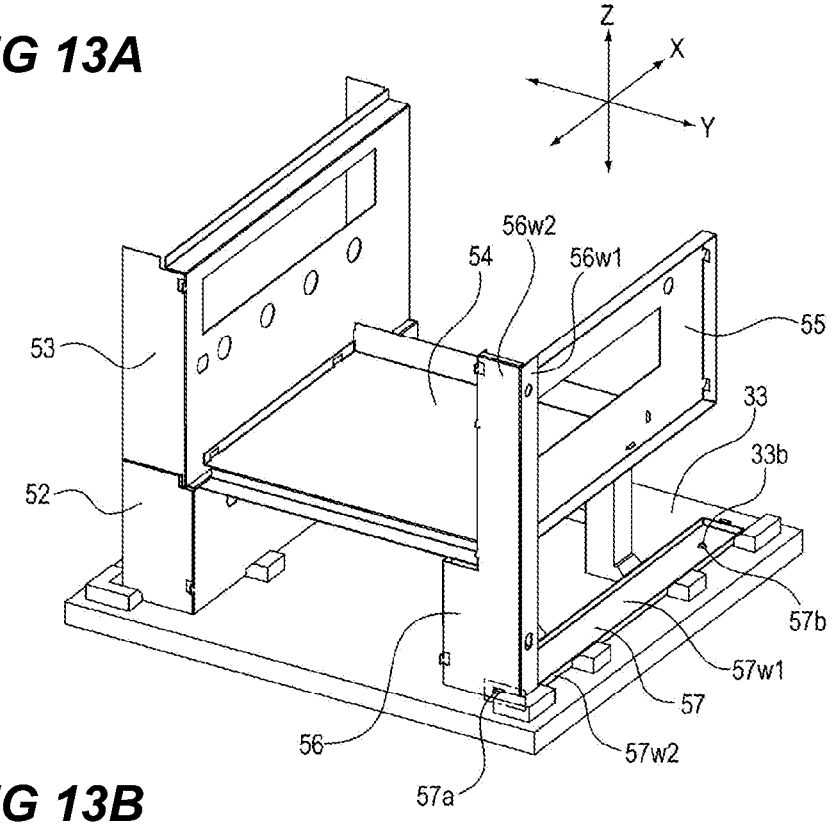
FIGS. 13A and 13B are perspective views when a front lower stay is assembled.
Figure 13B:
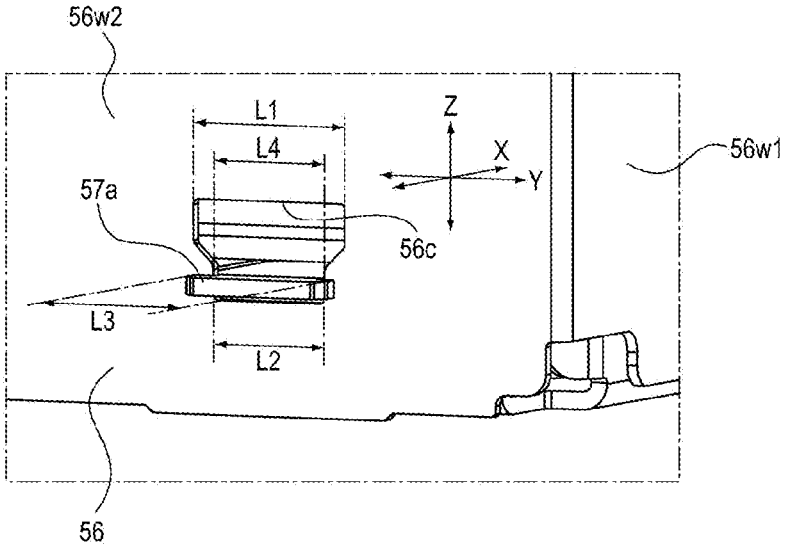

Next, as illustrated in FIGS. 13A and 13B, the front lower stay 57 is assembled. The front lower stay 57 is arranged on the stand 33, and is inserted and assembled into the left support column 56. The front lower stay 57 has a flat surface portion 57w1, which is a flat surface to be placed on the stand 33, and a bent and raised portion 57w2 formed by bending and raising each of both end portions of the flat surface portion 57w1 in the arrow X direction and the arrow Y direction substantially vertically and upward from the flat surface portion 57w1. The bent and raised portion 57w2 of the front lower stay 57 is provided with a protrusion portion 57a protruding in an insertion direction (arrow X direction) into the left support column 56. Positioning holes 57b penetrating the flat surface portion 57w1 in a plate thickness direction (arrow Z direction) of the flat surface portion 57w1 are formed in the flat surface portion 57w1 of the front lower stay 57. In addition, a through-hole 56c penetrating the flat surface portion 56w2 in a plate thickness direction (arrow X direction) of the flat surface portion 56w2 is formed in the flat surface portion 56w2 of the left support column 56. Here, a width of an upper end portion of the through-hole 56c is L1 and a width of a lower end portion of the through-hole 56c is L2. In addition, a width of a tip portion of the protrusion portion 57a is L3 and a width of a base plate portion of the protrusion portion 57a is L4. At this time, relationships of $L1>L2$, $L4<L3$, $L1\approx L3$, and $L2\approx L4$ are satisfied.

The protrusion portion 57a of the front lower stay 57 is inserted into and engaged with a through-hole 56c formed in the flat surface portion 56w2 of the left support column 56. At this time, the protrusion portion 57a is inserted from an upper side of the through-hole 56c, and then moved to the lower end portion of the through-hole 56c by the force or gravity of an assembly operator. Here, when the protrusion portion 57a is located at a lower end portion of the through-hole 56c, movement of the protrusion portion 57a with respect to the through-hole 56c in a direction opposite to the insertion direction is restricted by the relationship of $L3>L2$. In addition, when the front lower stay 57 is arranged on the stand 33, the positioning pins 33b of the stand 33 are inserted into the positioning holes 57b of the front lower stay 57. As a result, a position of the front lower stay 57 with respect to the stand 33 is determined.

Figure 14:
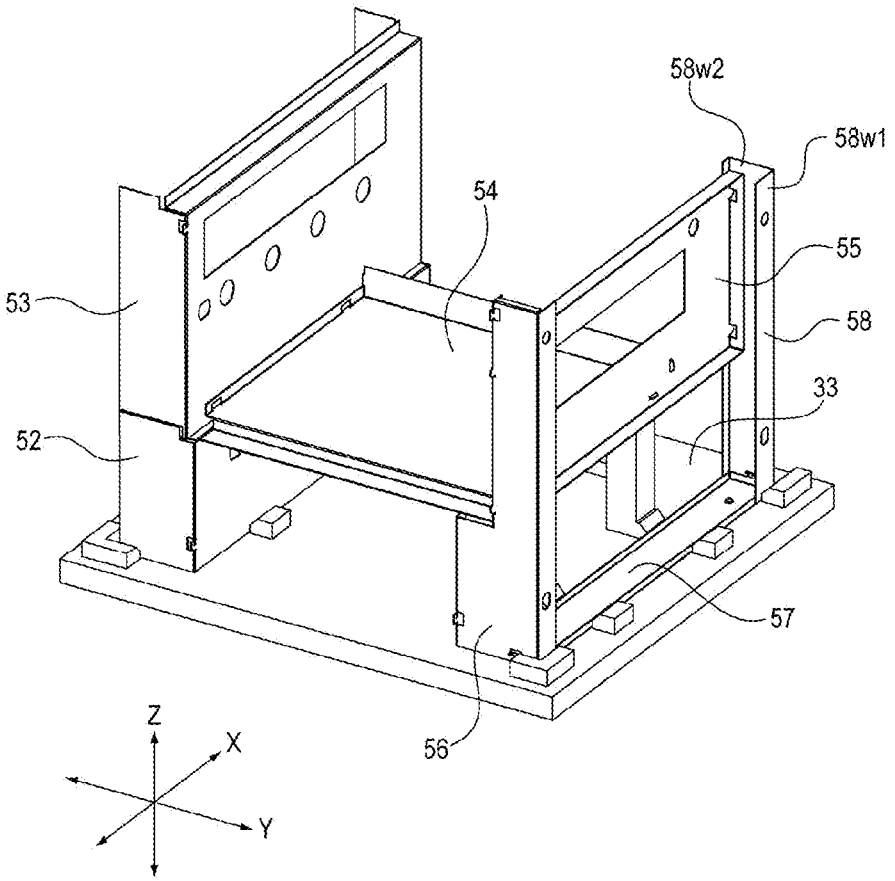
FIG. 14 is a perspective view when a right support column is assembled.

Next, as illustrated in FIG. 14, the right support column 58 is assembled. The right support column 58 is arranged on the stand 33. In addition, the front side plate 55 is inserted and assembled into the right support column 58. The right support column 58 has a flat surface portion 58w1 extending in parallel with the flat surface portion 55w1 of the front side plate 55 and a flat surface portion 58w2 bent substantially vertically from the flat surface portion 58w1 forward of the image forming apparatus A. An assembly configuration of the right support column 58 and the front side plate 55 is similar to that of the left support column 56 and the front side plate 55. That is, a through-hole (not illustrated) penetrating a bent portion of a boundary between the flat surface portion 58*w*1 and the flat surface portion 58*w*2 of the right support column 58 in the arrow Y direction is formed in the bend portion. A protrusion portion (not illustrated) formed in the bent and raised portion 55*w*2 of the front side plate 55 and protruding in an insertion direction (arrow Y direction) into the right support column 58 is inserted into this through-hole. In addition, a through-hole (not illustrated) penetrating the flat surface portion 58*w*2 in a plate thickness direction (arrow X direction) of the flat surface portion 58*w*2 is formed in the flat surface portion 58*w*2 of the right support column 58. A projection portion (not illustrated) formed in the bent and raised portion 55*w*2 of the front side plate 55 and protruding in the arrow X direction engages with this through-hole.

At a point in time when the frame 31 is assembled up to now, the frame 31 can stand for oneself. That is, the frame 31 can stand for oneself by assembling the front side plate 55, the right support column 58, the left support column 56, the front lower stay 57, which are the frame 31 on the front surface side of the image forming apparatus A, the rear bottom plate 51 and the rear side plates 52 and 53, which are the frame on the rear surface side of the image forming apparatus A, and the middle stay 54, which is the frame 31 connecting the frame on the front surface side and the frame on the rear surface side to each other, to each other.

Figure 15A:
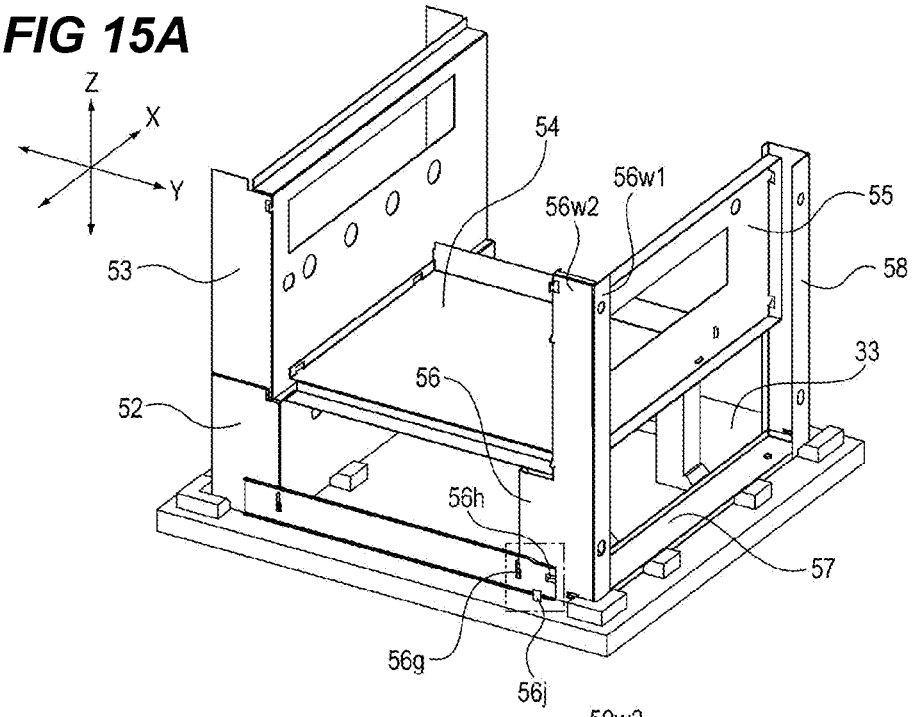
FIGS. 15A and 15B are perspective views when a left lower stay is assembled.
Figure 15B:
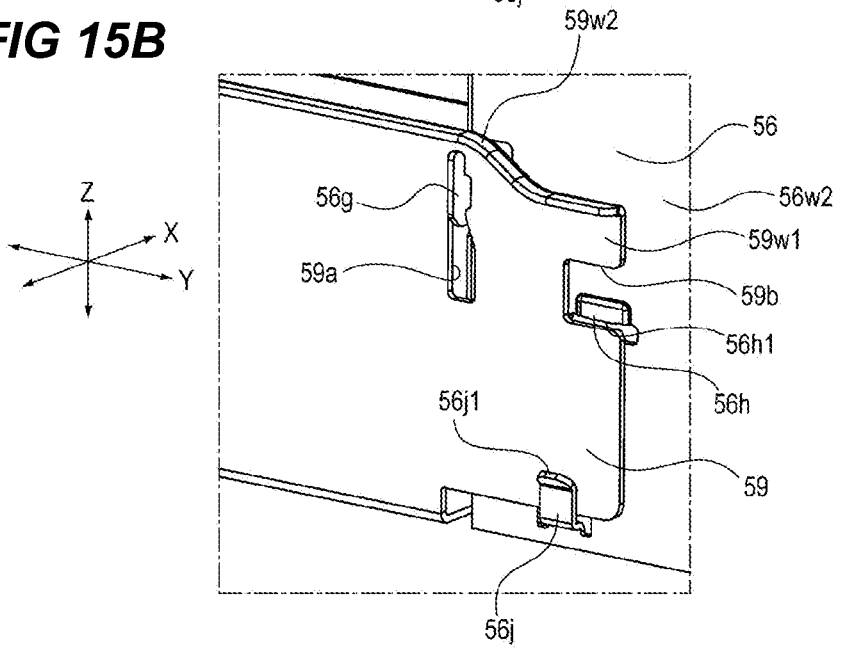

Next, as illustrated in FIGS. 15A and 15B, the left lower stay 59 is assembled. The left lower stay 59 has a flat surface portion 59*w*1 extending in parallel with the flat surface portion 56*w*2 of the left support column 56 and a bent and raised portion 59*w*2 bent and raised in a plate thickness direction (arrow X direction) of the flat surface portion 59*w*1 at an upper portion of the flat surface portion 59*w*1. The left lower stay 59, and the rear side plate 52 and the left support column 56 are inserted and assembled into each other from the vertical direction. An assembly configuration of the left lower stay 59 and the left support column 56 and an assembly configuration of the left lower stay 59 and the rear side plate 52 are similar to each other. Therefore, only the assembly configuration of the left lower stay 59 and the left support column 56 will be described here.

The flat surface portion 56*w*2 of the left support column 56 is provided with a protrusion portion 56*g* and a step-bent portion 56*j* that protrude in an insertion direction (arrow Z direction) into the left lower stay 59 and a projection portion 56*h* that protrudes in a plate thickness direction (arrow X direction) of the flat surface portion 56*w*2. The step-bent portion 56*j* has a portion bent in the plate thickness direction of the flat surface portion plate 56*w*2 and a portion bent and extended from that portion in the insertion direction into the left lower stay 59. In addition, a tip portion of the step-bent portion 56*j* is an inclined portion 56*j*1 inclined in a direction away from the flat surface portion 56*w*2 with respect to the insertion direction of the left support column 56 into the left lower stay 59. In addition, a through-hole 59*a* penetrating the flat surface portion 59*w*1 in the plate thickness direction (arrow X direction) of the flat surface portion 59*w*1 and a notch portion 59*b* notched in the flat surface direction of the flat surface portion 59*w*1 are formed in the flat surface portion 59*w*1 of the left lower stay 59.

The protrusion portion 56*g* of the left support column 56 is inserted into and engaged with the through-hole 59*a* formed in the flat surface portion 59*w*1 of the left lower stay 59. Here, a width of the protrusion portion 56*g* in the arrow Y direction and a width of the through-hole 59*a* in the arrow Y direction are substantially the same as each other. Therefore, the protrusion portion 56*g* is inserted into the through-hole 59*a*, such that a position of the left lower stay 59 with respect to the left support column 56 in the arrow Y direction is determined.

In addition, the step-bent portion 56*j* of the left support column 56 is inserted into and engaged with a lower end portion of the flat surface portion 59*w*1 of the left lower stay 59. As a result, the flat surface portion 59*w*1 of the left lower stay 59 is sandwiched from the plate thickness direction (arrow X direction) of the flat surface portion 59*w*1 by the step-bent portion 56*j* and the flat surface portion 56*w*2 in the left support column 56, such that a position of the left lower stay 59 with respect to the left support column 56 in the arrow X direction is determined.

In addition, the projection portion 56*h* of the left support column 56 engages with the notch portion 59*b* formed in the left lower stay 59. As a result, an edge portion 56*h*1 of the projection portion 56*h* abuts on an inner wall of the notch portion 59*b*, such that movement of the left support column 56 with respect to the left lower stay 59 in a direction opposite to the insertion direction is restricted.

Figure 16A:
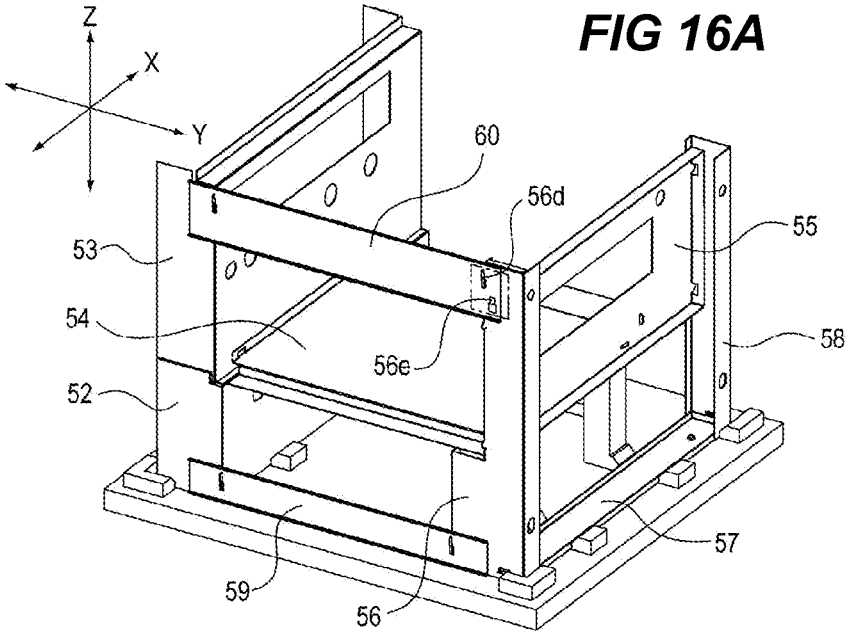
FIGS. 16A and 16B are perspective views when a left upper stay is assembled.
Figure 16B:
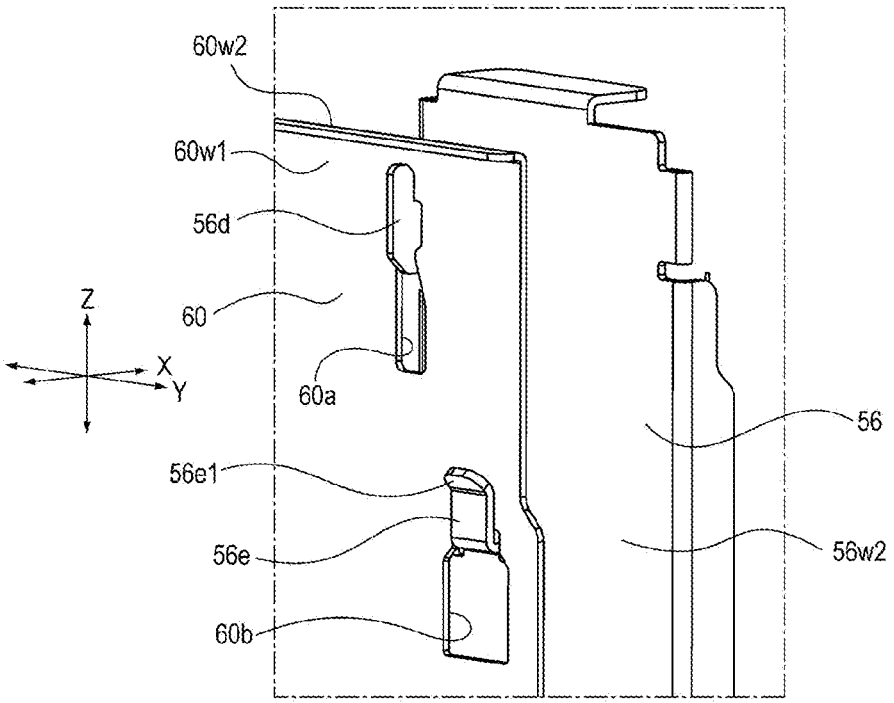

Next, as illustrated in FIGS. 16A and 16B, the left upper stay 60 is assembled. The left lower stay 59, and the rear side plate 53 and the left support column 56 are inserted and assembled into each other from the vertical direction. An assembly configuration of the left upper stay 60 and the rear side plate 53 and an assembly configuration of the left upper stay 60 and the left support column 56 are similar to each other. Therefore, only the assembly configuration of the left upper stay 60 and the left support column 56 will be described here.

A protrusion portion 56*d* and a step-bent portion 56*e* that protrude in an insertion direction (arrow Z direction) into the left upper stay 60 are formed in the flat surface portion 56*w*2 of the left support column 56. The step-bent portion 56*e* has a portion bent in the plate thickness direction (arrow X direction) of the flat surface portion plate 56*w*2 of the left support column 56 and a portion bent and extended from that portion in the insertion direction into the left upper stay 60. In addition, a tip portion of the step-bent portion 56*e* is an inclined portion 56*e*1 inclined in a direction away from the flat surface portion 56*w*2 with respect to the insertion direction of the left support column 56 into the left upper stay 60.

The left upper stay 60 has a flat surface portion 60*w*1 extending in parallel with the flat surface portion 56*w*2 of the left support column 56 and a bent and raised portion 60*w*2 bent and raised in a plate thickness direction (arrow X direction) of the flat surface portion 60*w*1 at an upper portion of the flat surface portion 60*w*1. Through-holes 60*a* and 60*b* penetrating through the flat surface portion 60*w*1 in the plate thickness direction (arrow X direction) of the flat surface portion 60*w*1 are formed in the flat surface portion 60*w*1 of the left upper stay 60.

The protrusion portion 56*d* of the left support column 56 is inserted into and engaged with the through-hole 60*a* formed in the flat surface portion 60*w*1 of the left upper stay 60. Here, a width of the protrusion portion 56*d* in the arrow Y direction and a width of the through-hole 60*a* in the arrow Y direction are substantially the same as each other. Therefore, the protrusion portion 56*d* is inserted into the through-hole 60*a*, such that a position of the left upper stay 60 with respect to the left support column 56 in the arrow Y direction is determined. In addition, the step-bent portion 56*e* of the left support column 56 is inserted into and engaged with the through-hole 60*b* of the left upper stay 60. As a result, the flat surface portion 60*w*1 of the left upper stay 60 is sandwiched from the plate thickness direction (arrow X direction) of the flat surface portion 60*w*1 by the step-bent portion 56*e* and the flat surface portion 56*w*2 in the left support column 56, such that a position of the left upper stay 60 with respect to the left support column 56 in the arrow X direction is determined.

Figure 17:
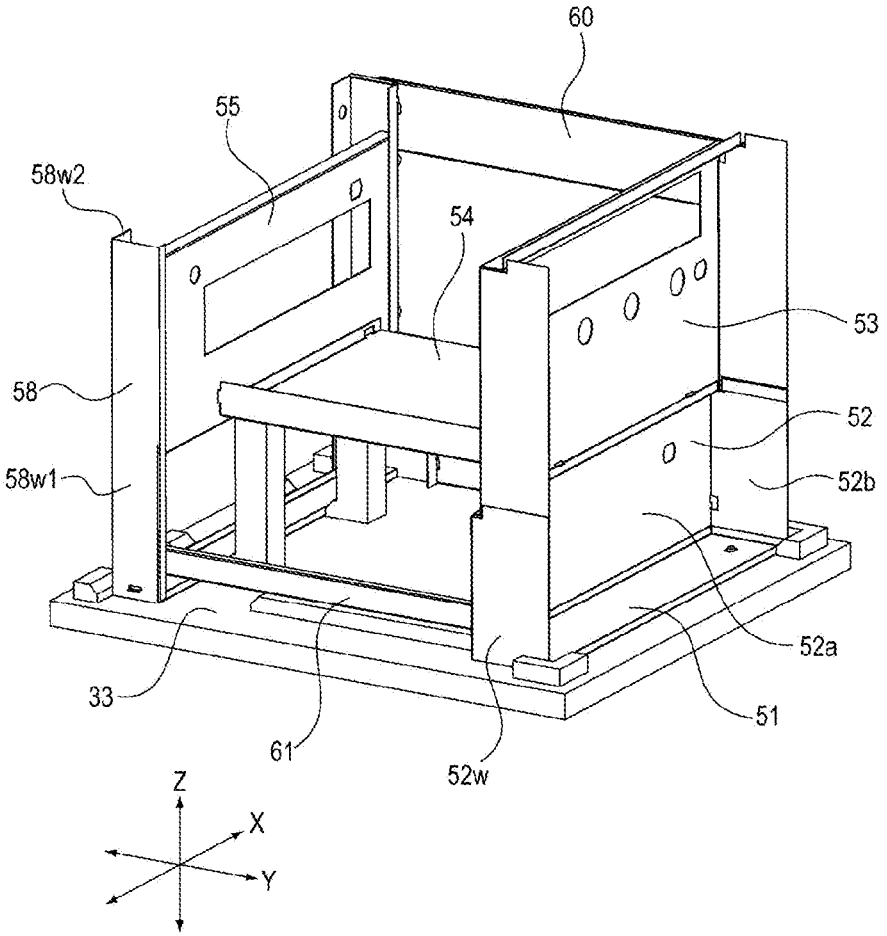
FIG. 17 is a perspective view when a right lower stay is assembled.

Next, as illustrated in FIG. 17, the right lower stay 61 is assembled. The right lower stay 61 is a member connecting between the rear side plate 52 and the right support column 58 facing each other, and is inserted and assembled into the rear side plate 52 and the right support column 58 from the horizontal direction (arrow Y direction) and the same direction. The right lower stay 61 is a member that guarantees a conveyance property of the sheet S. In addition, since the right lower stay 61 is located in the vicinity of a corner of the frame 31, the right lower stay 61 has an influence on rigidity of the frame 31. Therefore, it is particularly desirable that the right lower stay 61 is assembled with high position accuracy. Hereinafter, an assembly configuration of the right lower stay 61 will be described in detail.

Figure 18A:
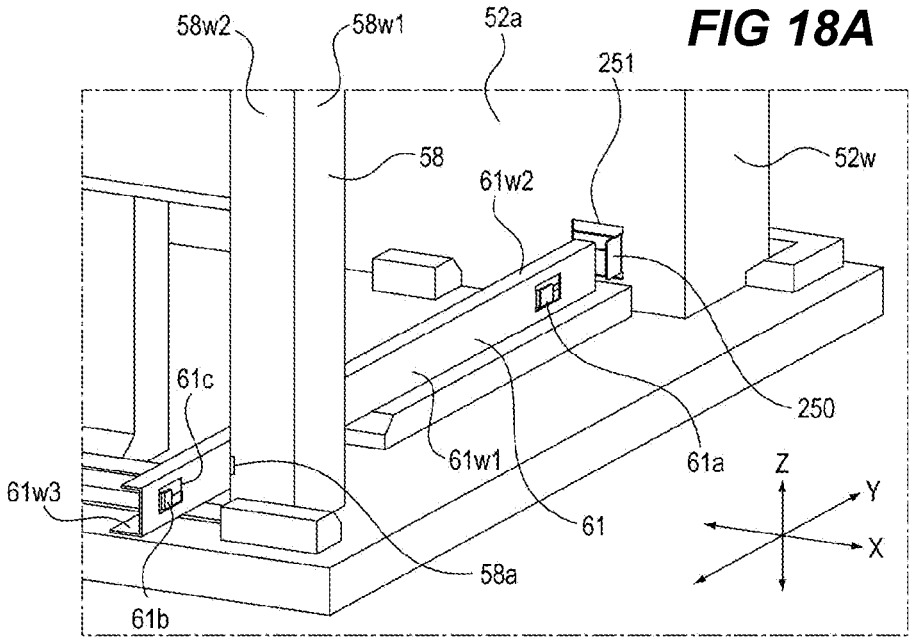
FIGS. 18A and 18B are perspective views of the right lower stay, the rear side plate, and the right support column.
Figure 18B:
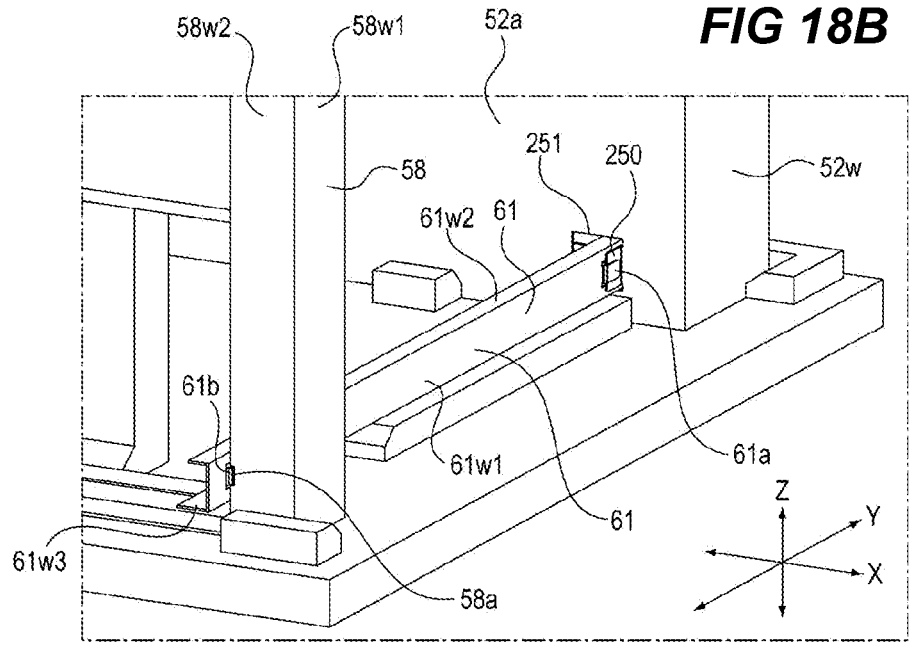
Figure 19A:
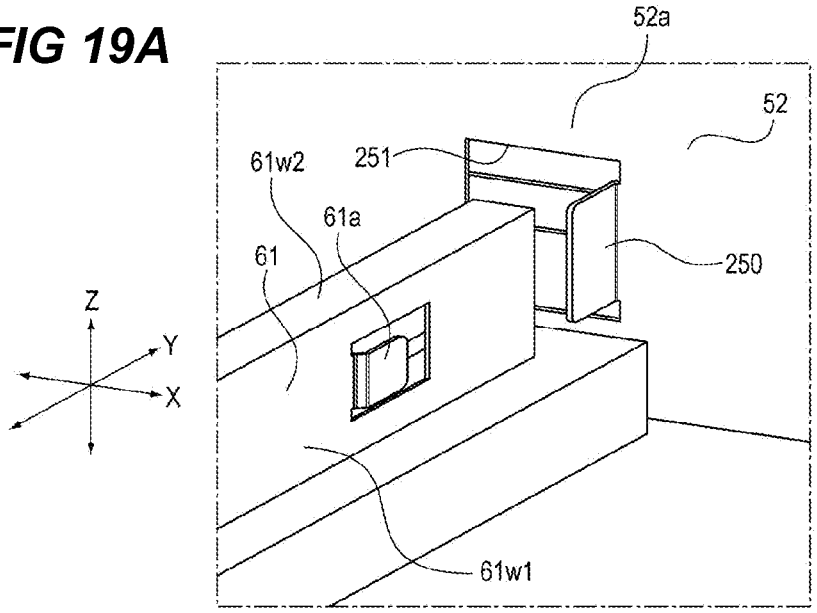
FIGS. 19A and 19B are enlarged perspective views of an engaging portion between the right lower stay and the rear side plate.
Figure 19B:
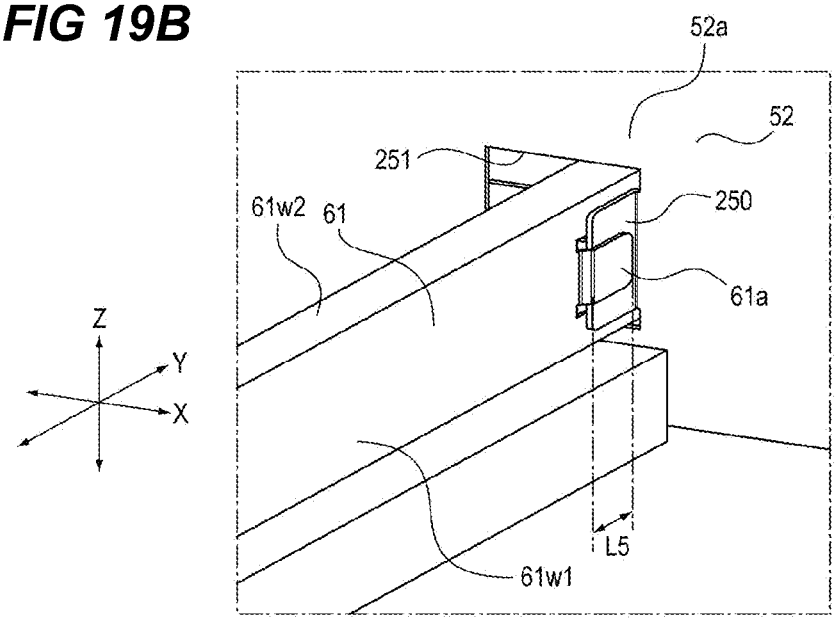
Figure 20A:
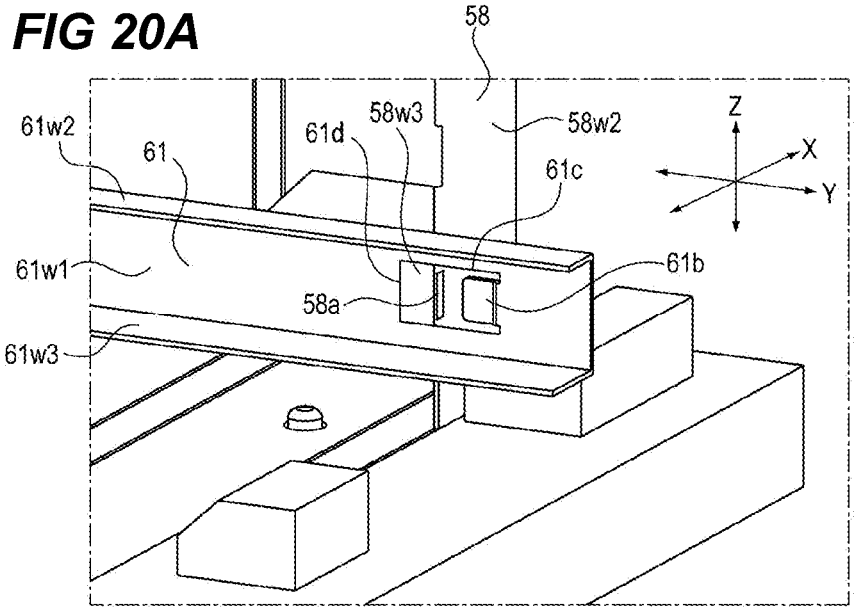
FIGS. 20A and 20B are enlarged perspective views of an engaging portion between the right lower stay and the right support column.
Figure 20B:
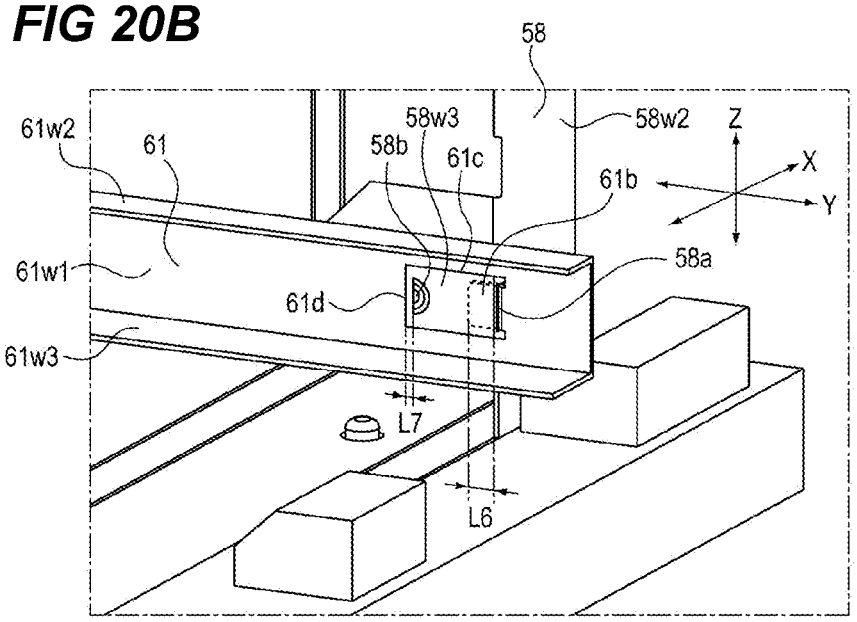

FIGS. 18A and 18B are perspective views of the right lower stay 61, the rear side plate 52, and the right support column 58. FIGS. 19A and 19B are enlarged perspective views of an engaging portion between the right lower stay 61 and the rear side plate 52. FIGS. 20A and 20B are enlarged perspective views of an engaging portion between the right lower stay 61 and the right support column 58. Here, FIGS. 18A, 19A, and 20A illustrate a state before the right lower stay 61 is assembled, and FIGS. 18B, 19B, and 20B illustrate a state where the right lower stay 61 is assembled.

First, an assembly configuration of the right lower stay 61 and the rear side plate 52 will be described. As illustrated in FIGS. 18A, 18B, 19A, and 19B, the flat surface portion 52*a* of the rear side plate 52 is provided with a bent portion 250 bent and raised in the arrow Y direction. In addition, a through-hole 251 penetrating the flat surface portion 52*a* in the plate thickness direction (arrow Y direction) of the flat surface portion 52*a* is formed around the bent portion 250, in the flat surface portion 52*a* of the rear side plate 52. As described above, the rear side plate 52 is formed of one sheet metal, and the through-hole 251 is a hole formed when the bent portion 250 is formed.

The right lower stay 61 includes three flat surfaces. The right lower stay 61 has a flat surface portion 61*w*1 extending substantially in parallel with the bent portion 52*w* of the rear side plate 52 and a flat surface portion 61*w*2 bent substantially vertically from the flat surface portion 61*w*1 in the arrow X direction at an upper portion of the flat surface portion 61*w*1. In addition, the right lower stay 61 has a flat surface portion 61*w*3 bent so as to face the flat surface portion 61*w*2 at a lower portion of the flat surface portion 61*w*1. The flat surface portion 61*w*1 of the right lower stay 61 is provided with a step-bent portion 61*a* inserted into and engaged with the bent portion 250 of the rear side plate 52. The step-bent portion 61*a* has a portion bent in a plate thickness direction (arrow X direction) of the flat surface portion plate 61*w*1 of the right lower stay 61 and a portion bent and extended from that portion in an insertion direction (arrow Y direction) into the rear side plate 52.

When the right lower stay 61 is assembled, the entirety of one end portion of the right lower stay 61 in the arrow Y direction is inserted into the through-hole 251 of the rear side plate 52, and the step-bent portion 61*a* of the right lower stay 61 is inserted into and engaged with the bent portion 250 of the rear side plate 52. As a result, the bent portion 250 of the rear side plate 52 is sandwiched from the plate thickness direction (arrow X direction) of the bent portion 250 by the step-bent portion 61*a* and the flat surface portion 61*w*1 in the right lower stay 61, such that a position of the right lower stay 61 with respect to the rear side plate 52 in the arrow X direction is determined.

In addition, the flat surface portion 61*w*2, which is an upper surface of the right lower stay 61, and an inner wall of an upper side of the through-hole 251 of the rear side plate 52 face each other with a predetermined interval therebetween, and the flat surface portion 61*w*3, which is a lower surface of the right lower stay 61, and an inner wall of a lower side of the through-hole 251 of the rear side plate 52 face each other with a predetermined interval therebetween. As a result, a position of the right lower stay 61 with respect to the rear side plate 52 in the vertical direction (arrow Z direction) is determined with a backlash corresponding to a predetermined interval.

Next, an assembly configuration of the right lower stay 61 and the right support column 58 will be described. As illustrated in FIGS. 18A, 18B, 20A, and 20B, an insertion hole 58*a* into which a step-bent portion 61*b* of the right lower stay 61 is inserted is formed in the flat surface portion 58*w*2 of the right support column 58. In addition, the right support column 58 has a flat surface portion 58*w*3 extending in the arrow Y direction from the periphery of the insertion hole 58*a* in the flat surface portion 58*w*2 rearward of the image forming apparatus A. The flat surface portion 58*w*3 is provided with a projection portion 58*b* protruding in a plate thickness direction (arrow X direction) of the flat surface portion 58*w*3 and having a substantially semicircular shape. The projection portion 58*b* is formed by drawing, and is arranged at a position adjacent to the insertion hole 58*a* in an insertion direction (arrow Y direction) of the step-bent portion 61*b* into the insertion hole 58*a*.

In addition, the flat surface portion 61*w*1 of the right lower stay 61 is provided with the step-bent portion 61*b* inserted into and engaged with the insertion hole 58*a* of the right support column 58. The step-bent portion 61*b* has a portion bent in the plate thickness direction (arrow X direction) of the flat surface portion plate 61*w*1 and a portion bent and extended from that portion in an insertion direction (arrow Y direction) into the right support column 58.

In addition, a through-hole 61*c* penetrating the flat surface portion 61*w*1 in the plate thickness direction of the flat surface portion 61*w*1 is formed around the step-bent portion 61*b* in the flat surface portion 61*w*1 of the right lower stay 61. The through-hole 61*c* is arranged at a position adjacent to the step-bent portion 61*b* in the insertion direction of the right lower stay 61 into the right support column 58. As described above, the right lower stay 61 is formed of one sheet metal, and the through-hole 61*c* is a hole formed when the step-bent portion 61*b* is formed.

When the right lower stay 61 is assembled, the step-bent portion 61*b* of the right lower stay 61 is inserted into and engaged with the insertion hole 58*a* of the right support column 58, and the projection portion 58*b* of the right support column 58 engages with the through-hole 61*c* of the right lower stay 61. As described above, the step-bent portion 61*b* engages with the insertion hole 58*a*, such that a position of the right lower stay 61 with respect to the right support column 58 in the arrow X direction and the arrow Y direction is determined. In addition, an upper surface of the step-bent portion 61*b* and an inner wall of an upper side of the insertion hole 58*a* face each other with a predetermined interval therebetween, and a lower surface of the step-bent portion 61*b* and an inner wall of a lower side of the insertion hole 58*a* face each other with a predetermined interval therebetween. As a result, a position of the right lower stay 61 with respect to the right support column 58 in the vertical direction (arrow Z direction) is determined with a backlash corresponding to a predetermined interval.

Note that in a process of inserting the step-bent portion 61*b* into the insertion hole 58*a*, the right lower stay 61 rides up by a height of a tip portion of the projection portion 58*b*. At this time, although a force is temporarily applied to the step-bent portion 61*b* in a direction in which the step-bent portion 61*b* opens, the height of the tip portion of the projection portion 58*b* is set to a height within a range in which the step-bent portion 61*b* is deformed in an elastic region.

In addition, in a state where the right lower stay 61 engages with the rear side plate 52 or the right support column 58, the projection portion 58*b* abuts on an inner wall 61*d* of the through-hole 61*c*, such that movement of the right lower stay 61 with respect to the rear side plate 52 and the right support column 58 in a direction opposite to the insertion direction is restricted. That is, in order to detach the right lower stay 61 from the rear side plate 52 and the right support column 58, it is necessary to apply a force in both of the plate thickness direction of the flat surface portion 61*w*1 of the right lower stay 61 and a direction opposite to the insertion direction of the right lower stay 61 into the rear side plate 52 and the right support column 58 to the right lower stay 61.

Here, a length (distance) of each part in the insertion direction (arrow Y direction) of the right lower stay 61 into the rear side plate 52 and the right support column 58 is defined as follows. That is, an engagement length of the step-bent portion 61*a* with the bent portion 250 illustrated in FIG. 19B is L5, and an engagement length of the step-bent portion 61*b* with the insertion hole 58*a* in the insertion direction illustrated in FIG. 20B is L6. In addition, a distance between the tip portion of the projection portion 58*b* and the inner wall 61*d* of the through-hole 61*c* illustrated in FIG. 20B when the step-bent portion 61*a* engages with the bent portion 250 and the step-bent portion 61*b* engages with the insertion hole 58*a* is L7.

At this time, a relationship among L5, L6, and L7 is L5>L6>L7. As a result, even in a case where the right lower stay 61 has moved in the direction opposite to the insertion direction into the rear side plate 52 and the right support column 58, at a point in time when the projection portion 58*b* abuts on the inner wall 61*d* of the through-hole 61*c* to restrict the movement of the right lower stay 61, an engaging state between the step-bent portion 61*a* and the bent portion 250 and an engaging state between the step-bent portion 61*b* and the insertion hole 58*a* are maintained. Therefore, it is possible to prevent the right lower stay 61 from being separated from the rear side plate 52 or the right support column 58 to prevent position accuracy between the right lower stay 61, and the rear side plate 52 and the right support column 58 from being deteriorated.

In addition, by satisfying a relationship of L5>L6, engagement between the step-bent portion 61*a* and the bent portion 250 between which an engagement length is relatively long is performed first and engagement between the step-bent portion 61*b* and the insertion hole 58*a* between which an engagement length is relatively short is performed later, when the right lower stay 61 is assembled. By providing a difference between the engagement lengths as described above, the order of assembling the right lower stay 61 can be determined, such that workability at the time of assembling the right lower stay 61 can be improved.

Note that an engagement length of the right lower stay 61 with the through-hole 251 of the rear side plate 52 in the insertion direction at one end portion of the right lower stay 61 in the arrow Y direction is L8. In this case, a maximum engagement length of the right lower stay 61 with the rear side plate 52 in the insertion direction is L8. That is, a relationship of L5 to L8 is a relationship of L8>L5>L6>L7.

Figure 21:
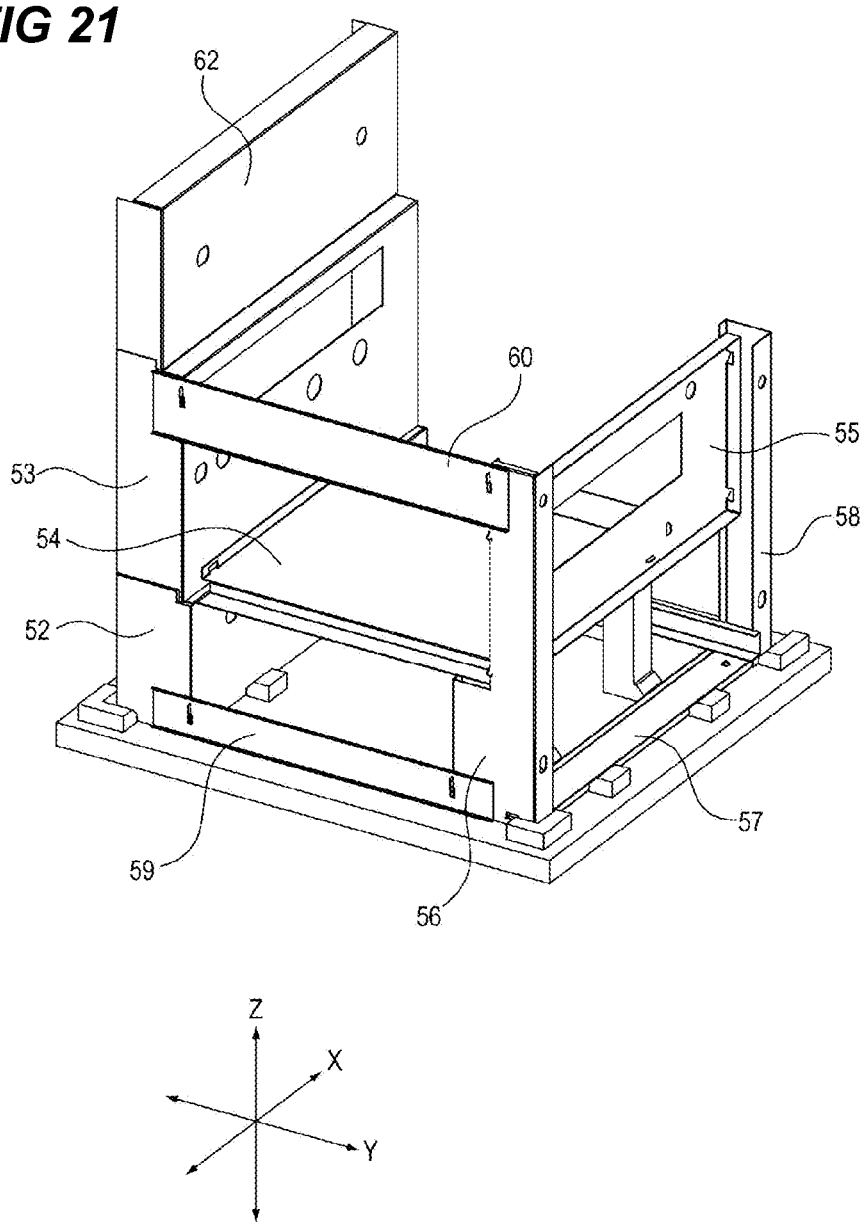
FIG. 21 is a perspective view when a rear side plate is assembled.

Next, as illustrated in FIG. 21, the rear side plate 62 is assembled. The rear side plate 62 is inserted and assembled into the rear side plate 53 from the arrow Z direction. An assembly configuration of the rear side plate 62 and the rear side plate 53 is similar to that of the rear side plate 52 and the rear side plate 53, and is an assembly configuration in which the rear side plate 62 and the rear side plate 53 are inserted into and engaged with each other.

Figure 22A:
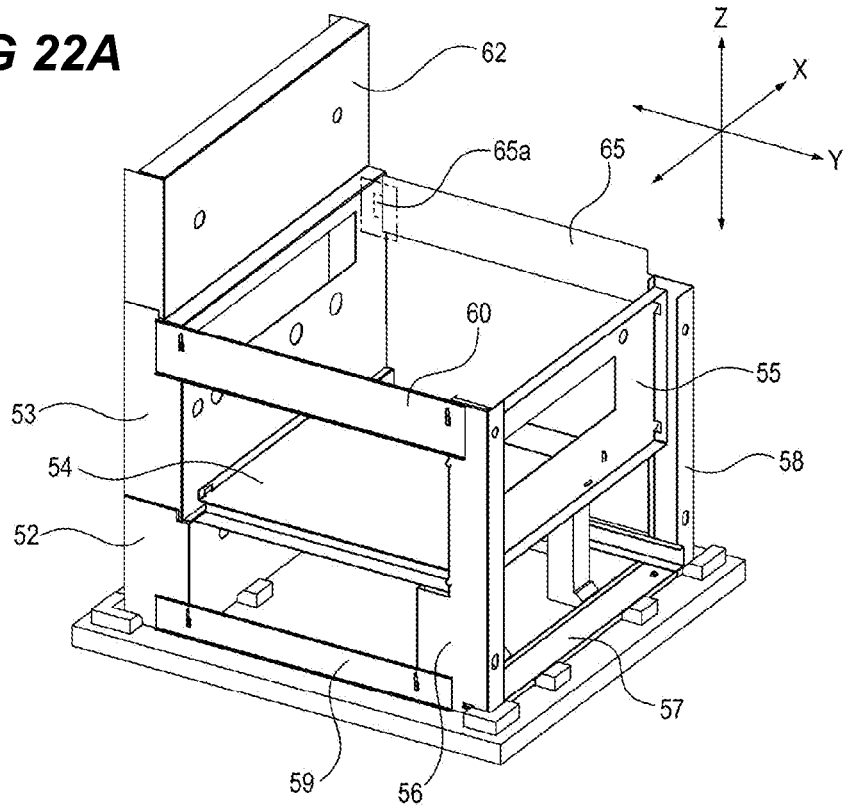
FIGS. 22A and 22B are perspective views when a right middle stay is assembled.
Figure 22B:
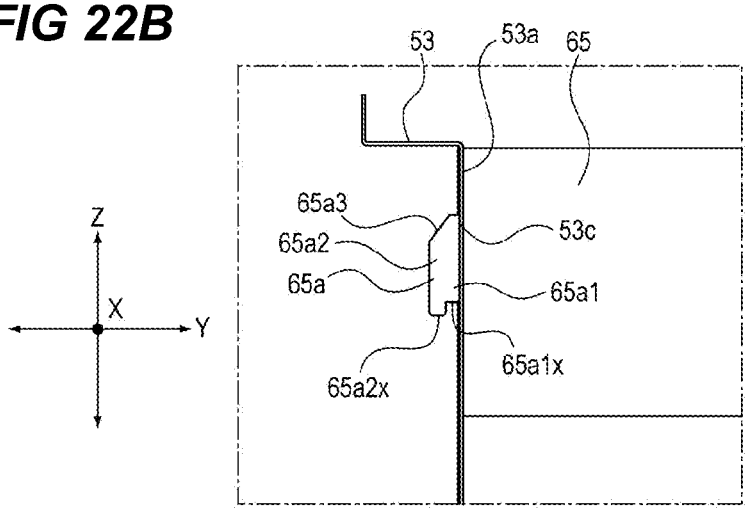

Next, as illustrated in FIGS. 22A and 22B, the right middle stay 65 is assembled. The right middle stay 65 is a plate-shaped member that is formed by one flat surface, and is a member that supports a fan cooling an end portion of the fixing portion 45 in a rotational axis direction. The right middle stay 65 is inserted and assembled into the rear side plate 53 and the right support column 58. An assembly configuration of the right middle stay 65 and the rear side plate 53 and an assembly configuration of the right middle stay 65 and the right support column 58 are similar to each other. Therefore, only the assembly configuration of the right middle stay 65 and the rear side plate 53 will be mainly described here.

Figures 23A, 23B:
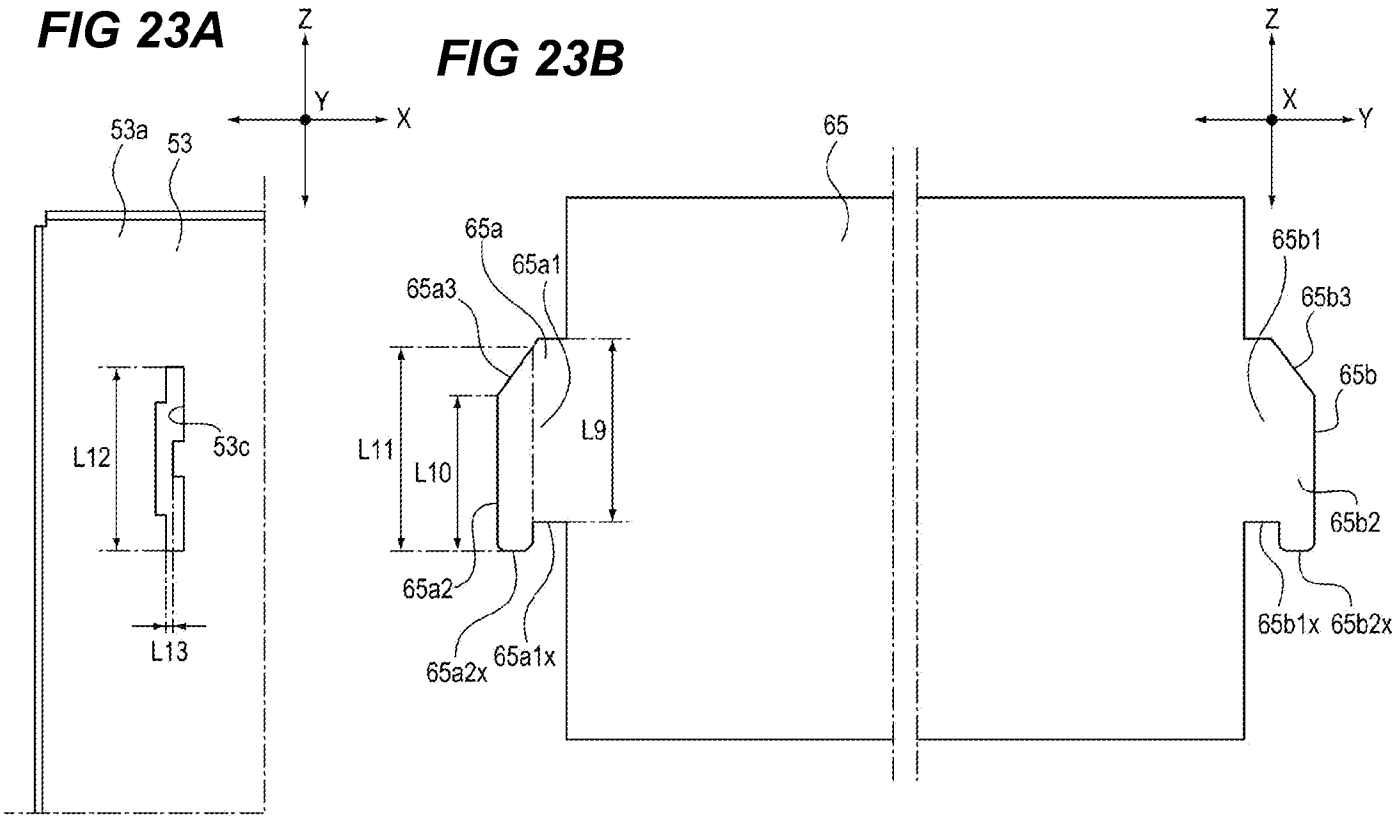
FIGS. 23A and 23B are enlarged views of an engaging portion between the rear side plate and the right middle stay.

FIG. 23A is an enlarged view of an engaging portion of the rear side plate 53 with the right middle stay 65. FIG. 23B is a front view of the right middle stay 65. As illustrated in FIGS. 23A and 23B, the support portion 53*a* of the rear side plate 53 (first support) extends in the vertical direction, and has a through-hole 53*c* penetrating therethrough in the plate thickness direction (arrow Y direction) of the support portion 53*a*.

In addition, the right middle stay 65 (second support) is provided with a protrusion portion 65*a* protruding in an insertion direction (arrow Y direction) into the support portion 53*a* of the rear side plate 53 and inserted into the through-hole 53*c* of the rear side plate 53 from the arrow Y direction. In addition, the right middle stay 65 is provided with a protrusion portion 65*b* protruding in an insertion direction (arrow Y direction) into the right support column 58 and inserted from the arrow Y direction into a through-hole (another through-hole) (not illustrated) penetrating the right support column 58 (third support) in a plate thickness direction (arrow Y direction) of the right support column 58.

The protrusion portion 65*a* (insertion portion) has a base portion 65*a*1 (first portion) fitted into the through-hole 53*c* and a hook portion 65*a*2 (second portion) provided in front of the base portion 65*a*1 in the insertion direction and having a lower end portion 65*a*2*x* located below a lower end portion 65*a*1*x* of the base portion 65*a*1 in the vertical direction. In addition, the protrusion portion 65*a* has an inclined portion 65*a*3 inclined so that a height decreases from an upper end portion of the base portion 65*a*1 to an upper end portion of the hook portion 65*a*2.

The protrusion portion 65*b* (another insertion portion) has the same shape as that of the protrusion portion 65*a*, and is inserted into the through-hole (not illustrated) of the right support column 58, similar to the protrusion portion 65*a*. That is, the protrusion portion 65*b* has a base portion 65*b*1 (third portion) fitted into the through-hole (not illustrated) of the right support column 58 and a hook portion 65*b*2 (fourth portion) provided in front of the base portion 65*b*1 in the insertion direction and having a lower end portion 65*b*2*x* located below a lower end portion 65$b$1$x$ of the base portion 65$b$1 in the vertical direction. In addition, the protrusion portion 65$b$ has an inclined portion 65$b$3 (another inclined portion) inclined so that a height decreases from an upper end portion of the base portion 65$b$1 to an upper end portion of the hook portion 65$b$2. Note that the right support column 58 is a member that extends in the vertical direction, and is arranged on a side opposite to a side where the rear side plate 53 is arranged in the horizontal direction, and the through-hole (not illustrated) of the right support column 58 also has the same shape as that of the through-hole 53$c$ of the rear side plate 53.

Here, a width L9 of the base portion 65$a$1 of the protrusion portion 65$a$ in the vertical direction and a width L12 of the through-hole 53$c$ in the vertical direction are substantially the same as each other. In addition, a plate thickness of the right middle stay 65 and a width L13 of the through-hole 53$c$ in the arrow X direction are substantially the same as each other. Therefore, the base portion 65$a$1 of the protrusion portion 65$a$ is fitted into the through-hole 53$c$, such that a position of the right middle stay 65 with respect to the rear side plate 53 in the vertical direction (arrow Z direction) and a position of the right middle stay 65 with respect to the rear side plate 53 in a direction (arrow X direction) orthogonal to the insertion direction and the vertical direction are determined. Here, in the present embodiment, both of the width L13 of the through-hole 53$c$ and the plate thickness of the protrusion portion 65$a$ of the right middle stay 65 are 0.8 mm Note that this dimension is a nominal value, and even in a case where a maximum tolerance between components is 0.06 mm, the width L13 of the through-hole 53$c$ is provided to be larger than the plate thickness of the protrusion portion 65$a$ of the right middle stay 65. As a result, even though where a tolerance varies in a manufacturing process of the right middle stay 65 and the rear side plate 53, the protrusion portion 65$a$ of the right middle stay 65 can be reliably inserted into the through-hole 53$c$ of the rear side plate 53, and the position of the right middle stay 65 with respect to the rear side plate 53 in the arrow X direction can be determined.

In addition, the lower end portion 65$a$2$x$ of the hook portion 65$a$2 protrudes downward of the lower end portion 65$a$1$x$ of the base portion 65$a$1 by about 2 mm. However, since a position of the upper end portion of the hook portion 65$a$2 is lowered by the inclined portion 65$a$3, the width L9 of the base portion 65$a$1 of the protrusion portion 65$a$ in the vertical direction and a width L10 of a tip portion of the hook portion 65$a$2 in the vertical direction have a relationship of L9>L10 therebetween. In addition, a relationship among the width L9 of the base portion 65$a$1 in the vertical direction, the width L10 of the tip portion of the hook portion 65$a$2 in the vertical direction, a maximum width L11 of the hook portion 65$a$2 in the vertical direction, and the width L12 of the through-hole 53$c$ in the vertical direction is L12≈L9≥L11>L10. That is, the inclined portion 65$a$3 is provided, such that the width of the hook portion 65$a$2 in the vertical direction becomes equal to or smaller than the width of the base portion 65$a$1 in the vertical direction.

Figure 24A:
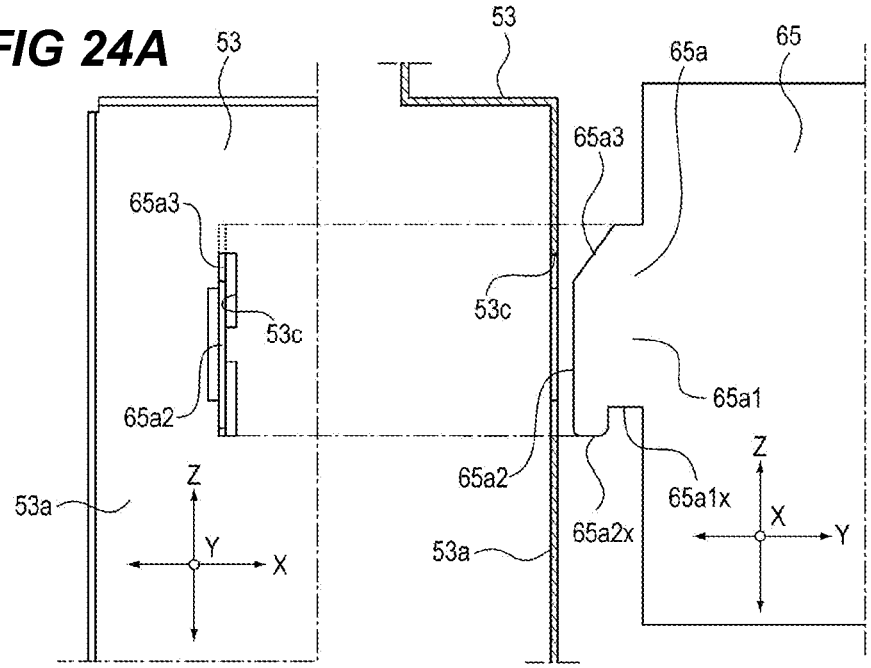
FIGS. 24A and 24B are views illustrating aspects where the right middle stay is inserted into the rear side plate.
Figure 24B:
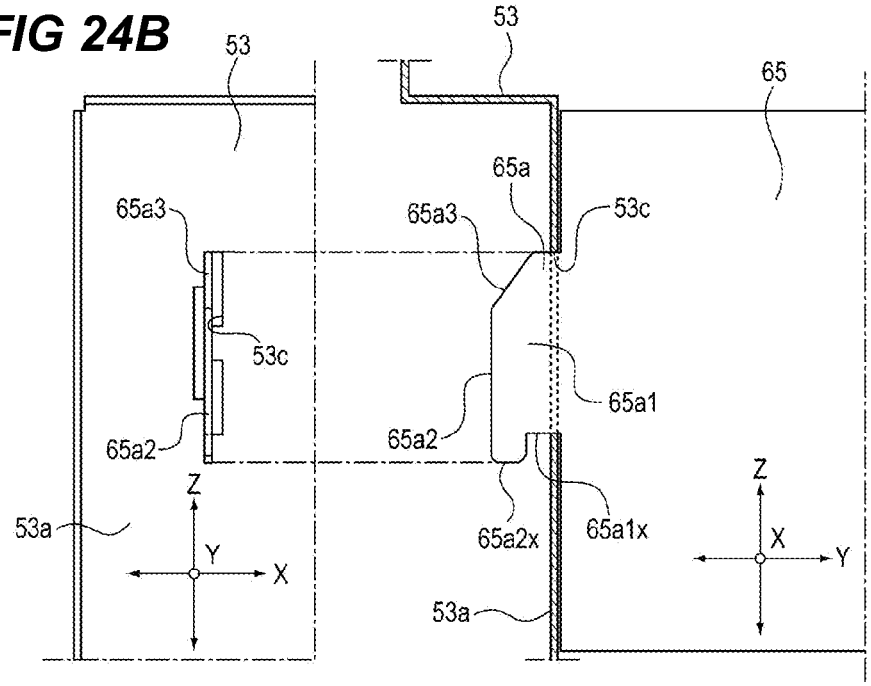

FIGS. 24A and 24B are views illustrating aspects where the protrusion portion 65$a$ of the right middle stay 65 is inserted into the through-hole 53$c$ of the rear side plate 53, in the order of FIG. 24A and FIG. 24B. As illustrated in FIGS. 24A and 24B, when the protrusion portion 65$a$ is inserted into the through-hole 53$c$, the hook portion 65$a$2, which is a tip portion of the protrusion portion 65$a$, is first inserted, the base portion 65$a$1 is inserted, and the base portion 65$a$1 is then fitted into the through-hole 53$c$. At this time, the protrusion portion 65$a$ can be inserted into the through-hole 53$c$ due to the relationship of L12≈L9≥L11>L10 described above.

In addition, in a state where the base portion 65$a$1 of the protrusion portion 65$a$ is fitted into the through-hole 53$c$, the lower end portion 65$a$2$x$ of the hook portion 65$a$2 is located at a position facing a portion below the through-hole 53$c$ in the support portion 53$a$ of the rear side plate 53. In the present embodiment, the lower end portion 65$a$2$x$ of the hook portion 65$a$2 protrudes downward of the lower end portion 65$a$1$x$ of the base portion 65$a$1 by 2 mm, and is provided so as to have an interval of 3 mm from a facing portion of the right middle stay that facing the support portion 53$a$ of the rear side plate 53. Here, a plate thickness of the support portion 53$a$ of the rear side plate 53 is about 1 mm, and a length of the base portion 65$a$1 of the protrusion portion 65$a$ in the arrow Y direction is larger than the plate thickness of the support portion 53$a$ of the rear side plate 53. As a result, even though the rear side plate 53 and the right middle stay 65 are relatively inclined during assembly, the hook portion 65$a$2 is hooked on the support portion 53$a$, such that movement of the right middle stay 65 with respect to the support portion 53$a$ of the rear side plate 53 in a direction opposite to the insertion direction is restricted. Therefore, the right middle stay 65 is prevented from being separated from the rear side plate 53, such that it is possible to assemble the right middle stay 65 and the rear side plate 53 to each other with high position accuracy. In addition, since the assembly configuration of the right middle stay 65 and the rear side plate 53 and the assembly configuration of the right middle stay 65 and the right support column 58 are the same as each other as described above, the right middle stay 65 is prevented from being separated from the right support column 58, such that it is possible to improve position accuracy of the right middle stay 65 and the right support column 58.

Figure 25B:
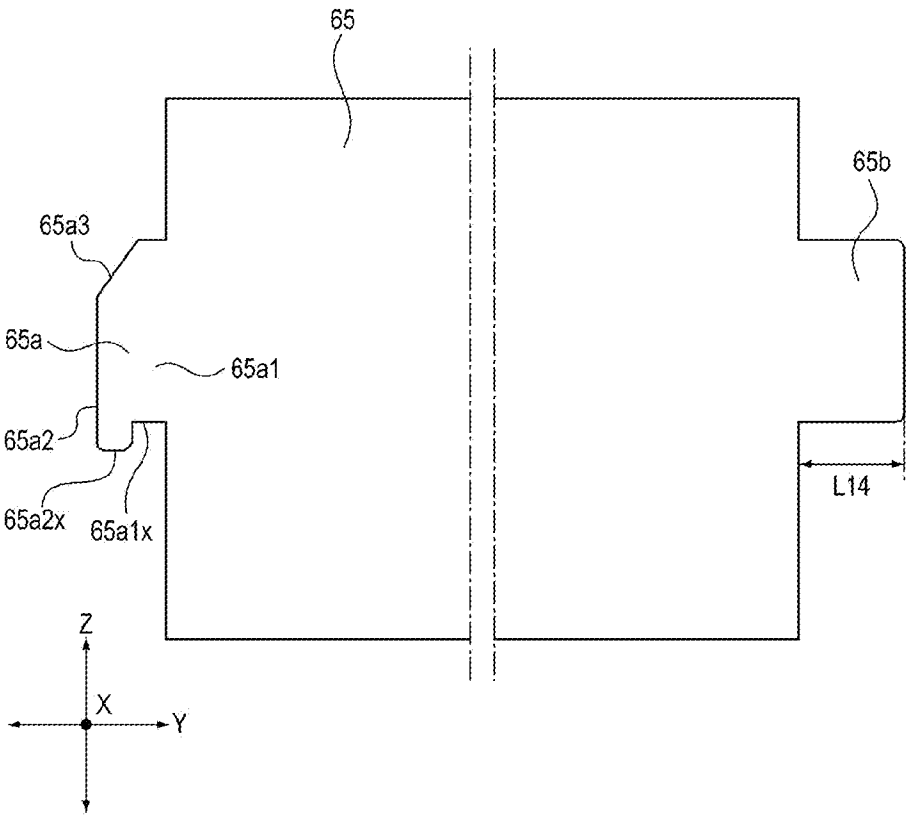
FIGS. 25A and 25B are views illustrating another configuration of the right middle stay.
Figure 25A:
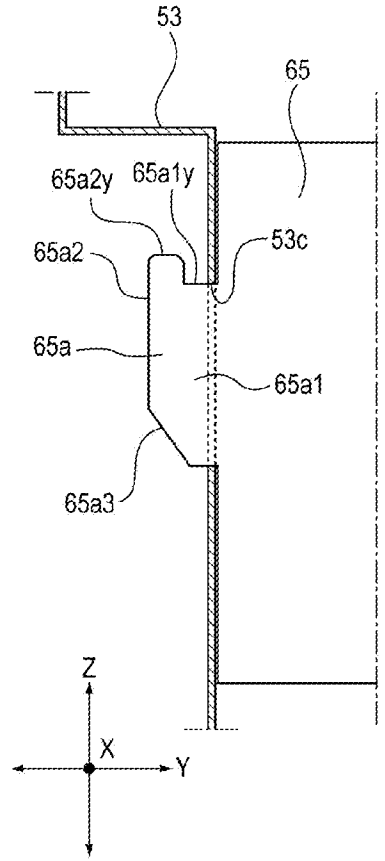

In addition, since the hook portion 65$a$2 of the protrusion portion 65$a$ protrudes downward in the vertical direction, the hook portion 65$a$2 is strongly hooked into the through-hole 53$c$ by a weight of the right middle stay 65, such that it is difficult for the right middle stay 65 and the rear side plate 53 to be separated from each other. That is, as illustrated in FIG. 25A, in a configuration in which an upper end portion 65$a$2$y$ of the hook portion 65$a$2 is located above an upper end portion 65$a$1$y$ of the base portion 65$a$1 in the vertical direction, the hook portion 65$a$2 is not firmly hooked into the through-hole 53$c$ by a weight of the right middle stay 65. In addition, the inclined portion 65$a$3 and an inner wall of the through-hole 53$c$ are in contact with each other, such that the protrusion portion 65$a$ is guided along a shape of the inclined portion 65$a$3 in a direction opposite to an inserting direction into the through-hole 53$c$ by the weight of the right middle stay 65. Therefore, a configuration in which the hook portion 65$a$2 protrudes downward in the vertical direction can be appropriate.

In addition, although the above effect can be obtained even though the upper end portion of the base portion 65$a$1 and the upper end portion of the hook portion 65$a$2 in the protrusion portion 65$a$ are stepped, the following effect is obtained by providing the inclined portion 65$a$3. That is, even in a case where the protrusion portion 65$a$ is insufficiently inserted into the through-hole 53$c$, when the rear side plate 53 is pressed toward the right middle stay 65 in a joining process or the like to be described later, the right middle stay 65 is guided by the inclined portion 65$a$3 to move to a desired position, and the protrusion portion 65$a$ is inserted into the through-hole 53$c$. Therefore, the protrusion portion 65*a* is provided with the inclined portion 65*a*3, such that it is possible to improve position accuracy of the right middle stay 65 with respect to the rear side plate 53.

Note that the protrusion portion 65*a* and the protrusion portion 65*b* in the right middle stay 65 have the same shape in the present embodiment, but the present invention is not limited thereto. That is, as illustrated in FIG. 25B, the protrusion portion 65*b* may not have the hook portion 65*b*2 or the inclined portion 65*b*3. In this case, a width L14 of the protrusion portion 65*b* in the insertion direction (arrow Y direction) into the right support column 58 can be larger than a movement amount (falling amount) at the time of assembly assumed for the right middle stay 65 and the right support column 58. For example, by setting the width L14 to 10 mm, it is possible to prevent the right middle stay 65 and the right support column 58 from being separated from each other even in a case where the right middle stay 65 moves up to 5 mm and the right support column 58 moves up to 5 mm.

Figure 26:
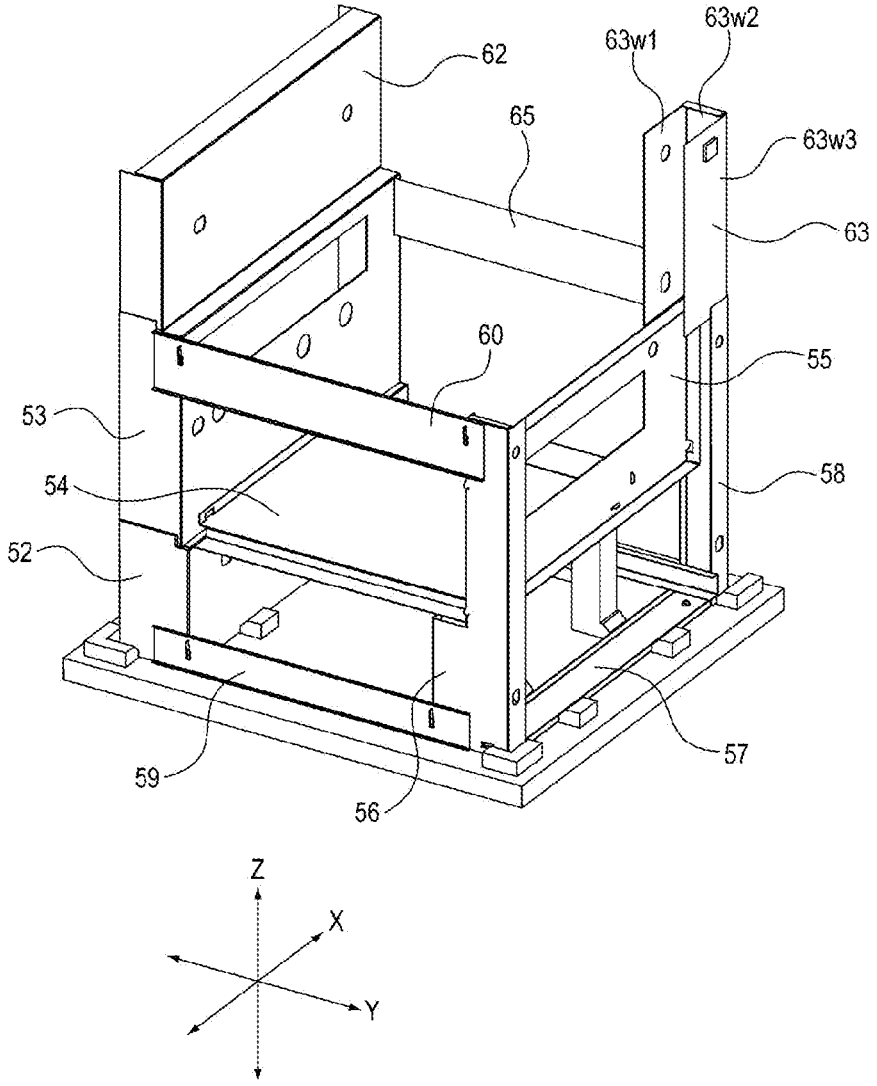
FIG. 26 is a perspective view when a right support column is assembled.

Next, as illustrated in FIG. 26, the right support column 63 is assembled. The right support column 63 has a flat surface portion 63*w*1 extending in parallel with the flat surface portion 55*w*1 of the front side plate 55, a flat surface portion 63*w*2 bent substantially vertically from the flat surface portion 63*w*1 in the arrow Y direction, and a flat surface portion 63*w*3 bent substantially vertically from the flat surface portion 63*w*2 so as to face the flat surface portion 63*w*1. The right support column 63 and the right support column 58 are inserted and assembled into each other.

Figure 27A:
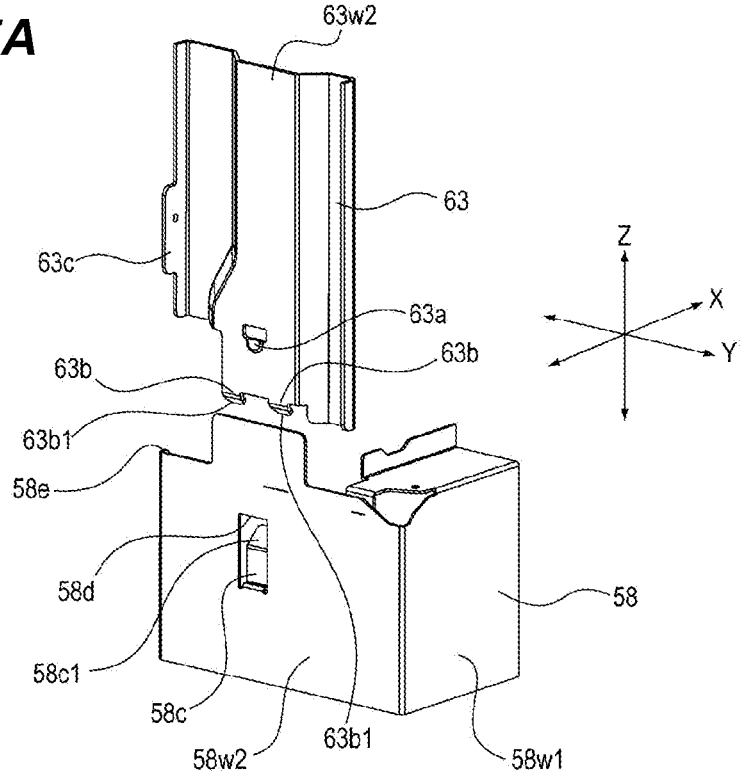
FIGS. 27A and 27B are enlarged perspective views of an engaging portion between the right support column and the right support column.
Figure 27B:
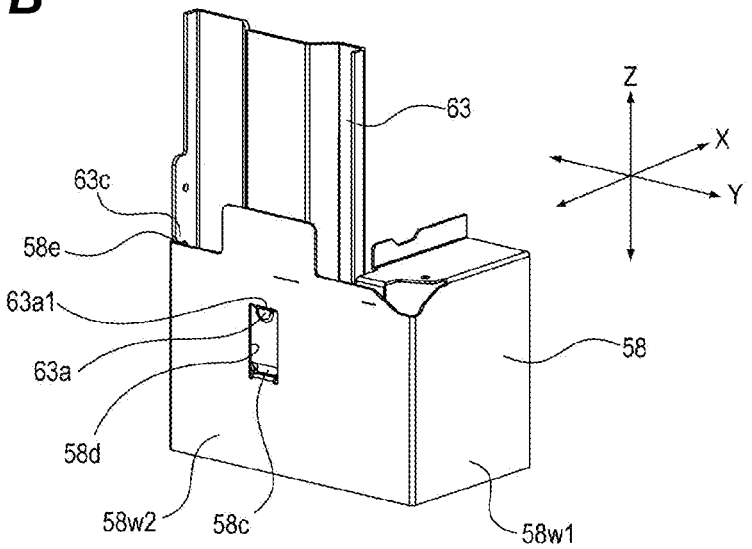

FIGS. 27A and 27B are enlarged perspective views of an engaging portion between the right support column 63 and the right support column 58. Here, FIG. 27A illustrates a state before the right support column 63 and the right support column 58 are assembled to each other, and FIG. 27B illustrates a state where the right support column 63 and the right support column 58 are assembled to each other.

As illustrated in FIGS. 27A and 27B, the flat portion 63*w*2 of the right support column 63 is provided with a projection portion 63*a* protruding in a plate thickness direction (arrow X direction) of the flat surface portion 63*w*2 and two protrusion portions 63*b* protruding in an insertion direction (arrow Z direction) into the right support column 58. The projection portion 63*a* is formed by drawing, and a protrusion amount of the projection portion 63*a* from a surface of the flat surface portion 63*w*2 is about 0.3 mm to 2 mm. In addition, a tip portion of the protrusion portion 63*b* is an inclined portion 63*b*1 inclined in a direction away from the flat surface portion 63*w*2 with respect to the insertion direction of the right support column 63 into the right support column 58.

The flat surface portion 58*w*2 of the right support column 58 is provided with a step-bent portion 58*c* protruding in an insertion direction (arrow Z direction) of the right support column 58 into the right support column 63. In addition, a through-hole 58*d* penetrating the flat surface portion 58*w*2 in a plate thickness direction (arrow X direction) of the flat surface portion 58*w*2 is formed at a position adjacent to the step-bent portion 58*c* in the insertion direction of the right support column 58 with respect to the right support column 63. The step-bent portion 58*c* has a portion bent in the plate thickness direction of the flat surface portion plate 58*w*2 and a portion bent and extended from that portion in the insertion direction into the right support column 63. In addition, a tip portion of the step-bent portion 58*c* is an inclined portion 58*c*1 inclined in a direction away from the flat surface portion 58*w*2 with respect to the insertion direction of the right support column 58 into the right support column 63.

When the right support column 63 is assembled to the right support column 58, the inclined portion 58*c*1 of the step-bent portion 58*c* of the right support column 58 abuts on the flat surface portion 63*w*2 of the right support column 63, and the inclined portion 63*b*1 of the protrusion portion 63*b* of the right support column 63 abuts on the flat surface portion 58*w*2 of the right support column 58. As a result, movement of the right support column 63 and the right support column 58 in the arrow Z direction is guided, and the flat surface portion 63*w*2 and the flat surface portion 58*w*2 move in a predetermined positional relationship. In addition, a lower end portion of a stopper portion 63*c* of the right support column 63 butts a butting portion 58*e*, which is an upper end portion of the flat surface portion 58*w*2 of the right support column 58, such that movement of the right support column 63 with respect to the right support column 58 in the insertion direction (arrow Z direction) is restricted.

When the right support column 63 is assembled to the right support column 58, the step-bent portion 58*c* of the right support column 58 is inserted into the flat surface portion 63*w*2 of the right support column 63 and engages with a lower end portion of the flat surface portion 63*w*2. As a result, the flat surface portion 63*w*2 of the right support column 63 is sandwiched from the plate thickness direction (arrow X direction) of the flat surface portion 63*w*2 by the step-bent portion 58*c* and the flat surface portion 58*w*2 in the right support column 58, such that a position of the right support column 63 with respect to the right support column 58 in the arrow X direction is determined.

In addition, the projection portion 63*a* of the right support column 63 engages with the through-hole 58*d* formed in the right support column 58. As a result, an edge portion 63*a*1 of the projection portion 63*a* abuts on an inner wall of the through-hole 58*d*, such that movement of the right support column 63 with respect to the right support column 58 in a direction opposite to the insertion direction is restricted. Here, the through-hole 58*d* is arranged at a position adjacent to the step-bent portion 58*c* in the insertion direction of the right support column 58 into the right support column 63. Therefore, the projection portion 63*a* engaged with the through-hole 58*d* and the step-bent portion 58*c* are arranged at positions adjacent to each other in the insertion direction.

In addition, in a direction (arrow Y direction) orthogonal to the plate thickness direction of the flat surface portion 63*w*2 and the insertion direction into the right support column 58, the two protrusion portions 63*b* of the right support column 63 engage with the step-bent portion 58*c* so as to sandwich the step-bent portion 58*c* of the right support column 58 therebetween. As a result, a position of the right support column 63 with respect to the right support column 58 in the orthogonal direction is determined.

As described above, the projection portion 63*a* restricting the movement of the right support column 63 with respect to the right support column 58 in the direction opposite to the insertion direction is provided in the vicinity of the step-bent portion 58*c* engaging the flat surface portion 63*w*2 of the right support column 63 and the flat surface portion 58*w*2 of the right support column 58 with each other. As a result, it is possible to prevent the right support column 63 from moving with respect to the right support column 58 in the direction opposite to the insertion direction, such that the right support column 63 and the right support column 58 are separated from each other, resulting in deterioration of position accuracy. Therefore, the right support column 63 and the right support column 58 that constitute the frame 31 can be assembled to each other with high position accuracy.

Figure 28A:
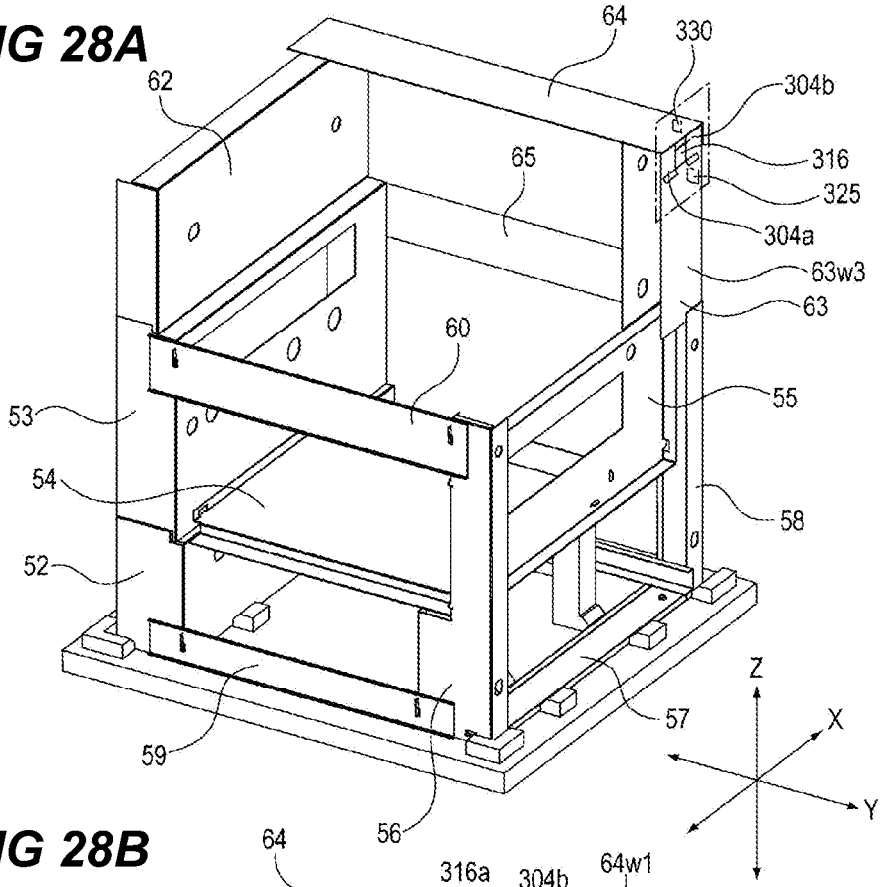
FIGS. 28A and 28B are perspective views when a right upper stay is assembled.
Figure 28B:
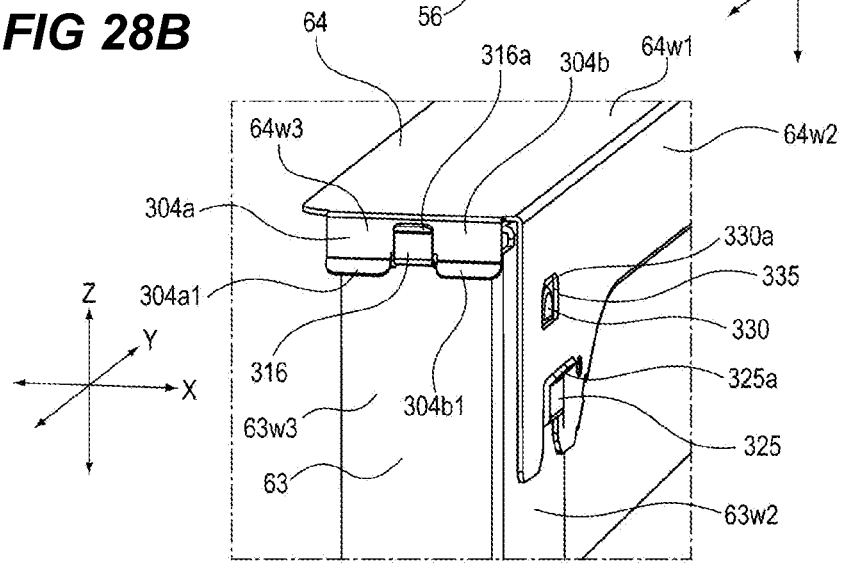

Next, as illustrated in FIGS. 28A and 28B, the right upper stay 64 is assembled. The right upper stay 64 has a flat surface portion 64*w*1 extending in the horizontal direction, a flat surface portion 64*w*2 formed by bending one end portion of the flat surface portion 64*w*1 in the arrow X direction substantially vertically in the vertical direction, and a flat surface portion 64*w*3 formed by bending one end portion of the flat surface portion 64*w*1 in the arrow Y direction substantially vertically in the vertical direction. In addition, the right upper stay 64 has a flat surface portion (not illustrated) formed by bending the other end portion of the flat surface portion 64*w*1 in the arrow Y direction substantially vertically in the vertical direction. The right upper stay 64, and the rear side plate 62 and the right support column 63 are inserted and assembled into with each other. An assembly configuration of the right upper stay 64 and the rear side plate 62 and an assembly configuration of the right upper stay 64 and the right support column 63 are similar to each other. Therefore, only the assembly configuration of the right upper stay 64 and the right support column 63 will be described here.

The flat surface portion 64*w*3 of the right upper stay 64 includes three bent portions 304*a*, 304*b*, and 304*c* bent from the flat surface portion 64*w*1 in an insertion direction (arrow Z direction) into the right support column 63. That is, when the flat surface portion 64*w*3 is divided into three portions in the arrow X direction, there are bent portions 304*a*, 304*b*, and 304*c*. The bent portion 304*c* is arranged at a position between the bent portion 304*a* and the bent portion 304*b* in the arrow X direction, and a length of the bent portion 304*c* in the arrow Z direction is smaller than that of the bent portions 304*a* and 304*b* in the arrow Z direction. In addition, the bent portions 304*a* and 304*b* have the same length in the arrow Z direction, and tip portions of the bent portions 304*a* and 304*b* are inclined portions 304*a*1 and 304*b*1 inclined in a direction away from the flat surface portion 64*w*1 with respect to the insertion direction into the right support column 63.

In addition, the flat surface portion 63*w*3 of the right support column 63 is provided with a step-bent portion 316 protruding in an insertion direction into the right upper stay 64 and inserted into and engaged with the right upper stay 64 so as to overlap with the bent portion 304*c* of the right upper stay 64 in a plate thickness direction (arrow Y direction) of the flat surface portion 63*w*3. In addition, the flat surface portion 63*w*2 of the right support column 63 is provided with a step-bent portion 325 protruding in the insertion direction into the right upper stay 64 and inserted into and engaged with the flat surface portion 64*w*2 so as to overlap with the flat surface portion 64*w*2 of the right upper stay 64 in a plate thickness direction (arrow X direction) of the flat surface portion 63*w*2. In addition, the flat surface portion 63*w*2 of the right support column 63 is provided with a projection portion 330 protruding in the plate thickness direction (arrow X direction) of the flat surface portion 63*w*2.

The step-bent portion 316 has a portion bent in the plate thickness direction (arrow Y direction) of the flat surface portion 63*w*3 of the right support column 63 and a portion bent and extended from that portion in the insertion direction (arrow Z direction) into the right upper stay 64. In addition, a tip portion of the step-bent portion 316 is an inclined portion 316*a* formed by further bending a portion of the step-bent portion 316 bent in the insertion direction into the right upper stay 64 and inclined in a direction away from the flat surface portion 63*w*3 with respect to the insertion direction into the right upper stay 64.

The step-bent portion 325 has a portion bent in the plate thickness direction (arrow X direction) of the flat surface portion 63*w*2 of the right support column 63 and a portion bent and extended from that portion in the insertion direction (arrow Z direction) into the right upper stay 64. In addition, a tip portion of the step-bent portion 325 is an inclined portion 325*a* formed by further bending a portion of the step-bent portion 325 bent in the insertion direction into the right upper stay 64 and inclined in a direction away from the flat surface portion 63*w*2 with respect to the insertion direction into the right upper stay 64.

When the right upper stay 64 is assembled to the right support column 63, the inclined portions 316*a* and 325*a* of the step-bent portions 316 and 325 of the right support column 63 abut on the right upper stay 64, and the inclined portion 304*a*1 and 304*b*1 of the bent portions 304*a* and 304*b* of the right upper stay 64 abut on the right support column 63. As a result, movement of the right upper stay 64 and the right support column 63 is guided, such that the right upper stay 64 and the right support column 63 move in a predetermined positional relationship.

When the step-bent portion 316 engages with the bent portion 304*c* of the right upper stay 64 and the bent portions 304*a* and 304*b* engage with the flat surface portion 63*w*3 of the right support column 63, the step-bent portion 316 and the bent portions 304*a* and 304*b* alternately perform engagement in a direction (arrow X direction) orthogonal to the insertion direction of the right support column 63 into the right upper stay 64 and the plate thickness direction. Specifically, the bent portion 304*a* engages with the flat surface portion 63*w*3 of the right support column 63 at a position adjacent to the step-bent portion 316 in the arrow X direction. In addition, the bent portion 304*b* engages with the flat surface portion 63*w*3 of the right support column 63 on a side opposite to a side where the bent portion 304*a* is arranged, with respect to the step-bent portion 316, and at a position adjacent to the step-bent portion 316, in the arrow X direction. With such a configuration, the right upper stay 64 and the right support column 63 are firmly engaged with and assembled to each other.

In addition, the projection portion 330 of the right support column 63 engages with a through-hole 335 formed in the flat surface portion 64*w*2 of the right upper stay 64 and penetrating the flat surface portion 64*w*2 in a plate thickness direction (arrow X direction) of the flat surface portion 64*w*2. As a result, an edge portion 330*a* of the projection portion 330 abuts on an inner wall of the through-hole 335, such that movement of the right upper stay 64 with respect to the right support column 63 in a direction opposite to the insertion direction is restricted.

As described above, the respective sheet metals constituting the frame 31 are assembled. The frame 31 assembled in the assembling process as described above is configured to be able to stand for oneself. Therefore, the frame 31 can be detached from the stand 33 by grasping the rear side plate 52, the left support column 56, the right support column 58, and the like, of the frame 31 and lifting the frame 31.

<Joining Process of Frame>

Next, a process of joining the frame 31 assembled in the assembling process described above will be described.

Figure 29:
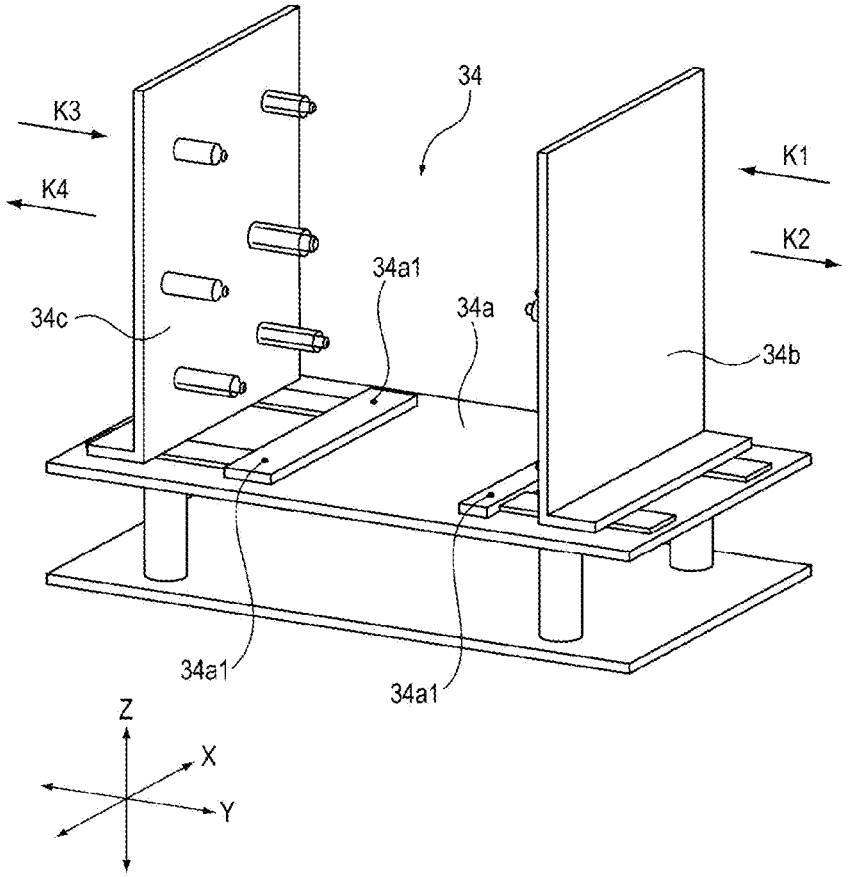
FIG. 29 is a perspective view of a jig used for joining of the frame.

FIG. 29 is a perspective view of a jig 34 used for joining of the frame 31. As illustrated in FIG. 29, the jig 34 has a base 34*a*, a front side support portion 34*b*, and a rear side support portion 34*c*. The base 34*a* is provided with positioning pins 34*a*1. In addition, the front side support portion 34*b* and the rear side support portion 34*c* are configured to be slidable with respect to the base 34*a*. The front side support portion 34*b* is slidable in an arrow K1 direction and an arrow K2 direction, and the rear side support portion 34*c* is slidable in an arrow K3 direction and an arrow K4 direction.

Figure 30:
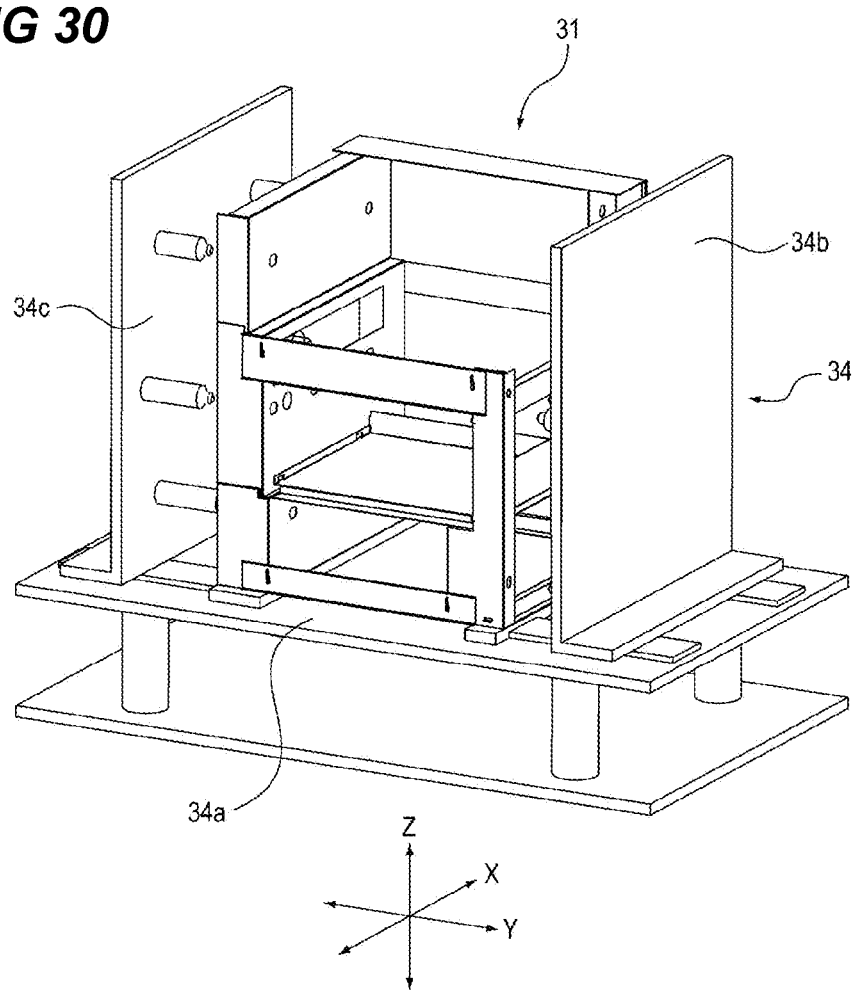
FIG. 30 is a perspective view of the frame and the jig.

FIG. 30 is a perspective view of the frame 31 assembled in the assembling process described above and the jig 34. As illustrated in FIG. 30, the frame 31 is detached from the stand 33 and placed on the base 34*a* of the jig 34 after the assembling process. At this time, the positioning pins 34*a*1 of the base 34*a* are inserted into the positioning holes 51*a* of the rear bottom plate 51 of the frame 31 or the positioning holes 57*b* of the front lower stay 57, such that a position of the frame 31 with respect to the base 34*a* is determined.

Figure 31:
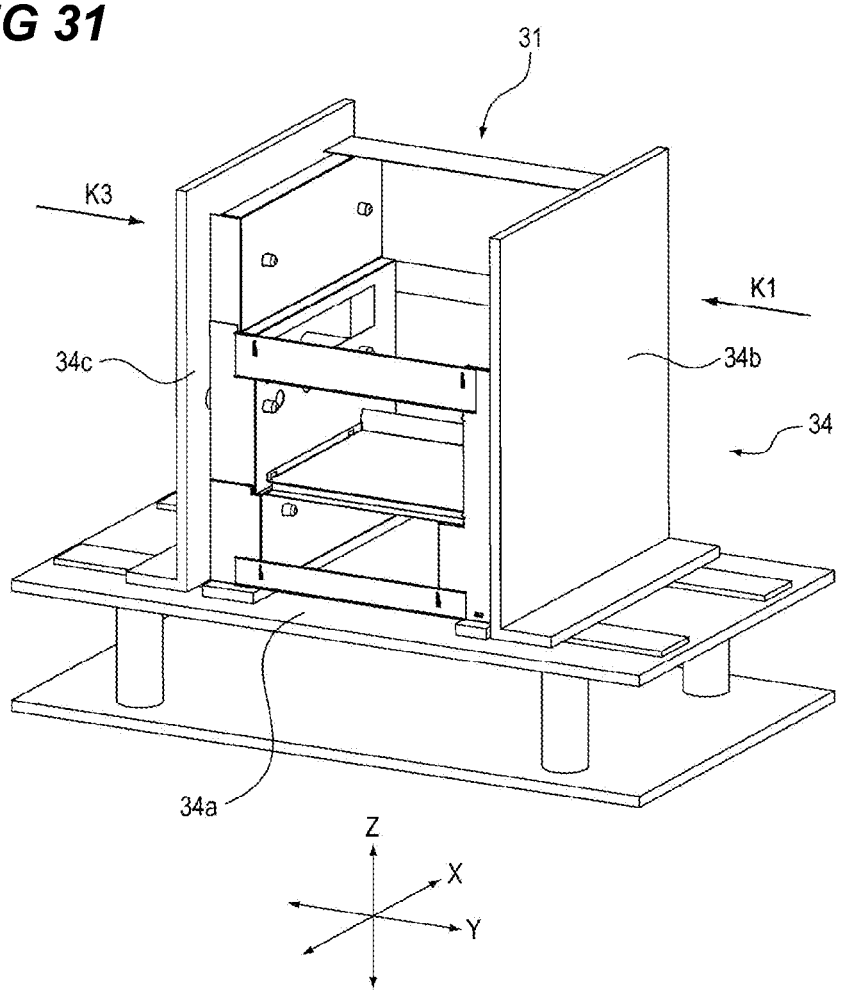
FIG. 31 is a perspective view of the frame and the jig.

As illustrated in FIG. 31, when joining the frame 31, an operator who performs a joining process slides the front side support portion 34*b* in the arrow K1 direction and slides the rear side support portion 34*c* in the arrow K3 direction. In addition, the frame 31 is pressed from a direction orthogonal to slide directions of the front side support portion 34*b* and the rear side support portion 34*c* and the vertical direction by a pressing device (not illustrated). As a result, the sheet metals constituting the frame 31 are pressed against each other, such that unnecessary gaps between the sheet metals are eliminated, and positioning is completed.

Then, the respective sheet metals constituting the frame 31 are joined to each other by fiber laser welding by the operator. When the joining of the frame 31 is completed, the operator slides the front side support portions 34*b* in the arrow K2 direction, slides the rear side support portions 34*c* in the arrow K4 direction, and detaches the frame 31 from the jig 34. As a result, the frame 31 is completed.

As described above, in the frame 31 of the image forming apparatus A, the sheet metals are engaged with each other and are prevented from coming off from each other by the shape of each sheet metal, such that mutual positioning of the sheet metals is performed. By performing the mutual positioning of the sheet metals, manufacturing accuracy of the frame 31 can be improved, and position accuracy of each unit such as the image forming portion supported by the frame 31 can be improved. Therefore, in the image forming apparatus A having the frame 31 using the embodiment described above, position accuracy between members supported by the frame is maintained, such that it becomes possible to form a high quality image.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-158414, filed Aug. 30, 2019, which is hereby incorporated by reference herein in its entirety.

What is claimed is:

1. A metal frame of an image forming apparatus, the image forming apparatus including an image forming unit which forms an image on a sheet, the metal frame comprising:

a first support member configured to support the image forming unit, the first support member including a metal plate formed with a slit portion, the slit portion being a through-hole;

a second support member which is arranged with an interval from the first support member and which is configured to support the image forming unit together with the first support member, the second support member including a metal plate; and a connecting member which is a metal plate connecting the first support member and the second support member, wherein the connecting member includes:

a first facing portion which faces a first region of the first support member adjacent to the slit portion; and a fitted portion which is supported by an inner peripheral surface of the slit portion and is fitted into the slit portion in a plate thickness direction of the fitted portion, wherein a length of the fitted portion in a first direction perpendicular to a plate thickness direction of the first support member and the plate thickness direction of the fitted portion in the slit portion is less than or equal to a length of the slit portion in the first direction, and wherein the fitted portion includes a hook portion having a hook shape and a second facing portion which faces a second region which is provided on a rear surface of a surface of the first support member on which the first region is provided, and which is adjacent to the slit portion in the first direction with a gap.

2. The metal frame of an image forming apparatus according to claim 1, wherein an upper end portion of the hook portion in the first direction is located below an upper end portion of the slit portion in the first direction.

3. The metal frame of an image forming apparatus according to claim 2, wherein the hook portion has an inclined portion inclined so that a height in the first direction increases from an upper end portion of the end surface of the connecting member toward the slit portion.

4. The metal frame of an image forming apparatus according to claim 1, wherein the first support member includes a first side plate supporting the image forming unit, wherein the second support member includes a second side plate supporting the image forming unit together with the first side plate, a first support column supporting one end portion of the second side plate in a plate thickness direction of the connecting member, and a second support column supporting the other end portion of the second side plate in the plate thickness direction of the connecting member, and wherein the connecting member connects the first side plate and the first support column.

5. An image forming apparatus comprising:

an image forming unit which forms an image on a sheet;

the metal frame of an image forming apparatus according to claim 1; and an outer cover which covers the metal frame of an image forming apparatus.

6. The metal frame of an image forming apparatus according to claim 4, wherein the first support column is a metal plate supporting the second side plate and has another slit portion formed therein, the other slit portion being a through-hole, wherein the connecting member includes:

another facing portion which faces a first region of the first support column adjacent to the other slit portion; and another fitted portion which is supported by an inner peripheral end surface of the other slit portion and is fitted into the other slit portion in a plate thickness direction of the other fitted portion, wherein a length of the other fitted portion in the first direction is less than or equal to a length of the other slit portion in the first direction, and wherein the other fitted portion includes another hook portion which is provided on a rear surface of a surface of the first support column on which the first region is provided, includes an end surface of the connecting member facing a second region of the first support column adjacent to the other slit portion in the first direction, with a gap, and has a hook shape.

7. The metal frame of an image forming apparatus according to claim 6, wherein an upper end portion of the other hook portion in the first direction is located below an upper end portion of the other slit portion in the first direction.

8. The metal frame of an image forming apparatus according to claim 7, wherein the other hook portion has an inclined portion inclined so that a height in the first direction increases from an upper end portion of the end surface of the connecting member toward the other slit portion.

9. A metal frame of an image forming apparatus, the image forming apparatus including an image forming unit which forms an image on a sheet, the metal frame comprising:

a first support member configured to support the image forming unit, the first support member including a metal plate formed with a slit portion, the slit portion being a through-hole;

a second support member which is arranged with an interval from the first support member and which is configured to support the image forming unit with the first support member, the second support member including a metal plate; and a connecting member which is a metal plate, the connecting member configured to connect the first support member and the second support member, wherein the connecting member includes:

a first portion positioned between the first support member and the second support member in a plate thickness direction of the first support member, the first portion having a first facing portion which faces a first region of the first support member adjacent to the slit portion at the first supporting member, a fitted portion which is inserted to the slit portion, a second portion positioned on the opposite side to the first portion against the first support member in the plate thickness direction of the first support member, the second portion having, a second facing portion which faces a second region as a back face of the first region in the plate thickness direction of the first support member, a first end portion in a perpendicular direction to the plate thickness direction of the first support member and the plate thickness direction of the connecting member;

a second end portion disposed on the opposite side to the second facing portion in the plate thickness direction of the first support member via the first end portion;

wherein the second facing portion, the first end portion and the second end portion are formed continuously, wherein the second end portion has a first edge connecting with the first end portion and a second edge positioned on the opposite side to the first edge in the perpendicular direction, wherein the second edge of the second end portion is overlapped with the slit portion in the perpendicular direction, wherein a length between the first edge and the second edge in the perpendicular direction is shorter than a length of the slit portion in the perpendicular direction, and a maximum length of the second portion in the perpendicular direction is larger than or equal to the length of the slit portion in the perpendicular direction, and wherein the first facing portion and the second facing portion faces to each other via the first support member apart with a space more than the plate thickness of the first supporting member.

10. The metal frame of an image forming apparatus according to claim 9, further comprising an inclined portion connecting from the second edge of the second end portion toward an upper end portion of the fitted portion in the perpendicular direction.

11. The metal frame of an image forming apparatus according to claim 9, wherein the second edge of the second end portion is disposed at a lower position than an upper end portion of the fitted portion in the perpendicular direction.

12. The metal frame of an image forming apparatus according to claim 9, wherein the first support member includes a first side plate supporting the image forming unit, wherein the second support member includes a second side plate supporting the image forming unit together with the first side plate, a first support column supporting one end portion of the second side plate in a plate thickness direction of the connecting member, and a second support column supporting the other end portion of the second side plate in the plate thickness direction of the connecting member, and wherein the connecting member connects the first side plate and the first support column.

13. The metal frame of an image forming apparatus according to claim 9, wherein the slit portion has a first projection which is projecting inwardly in the through-hole and a second projection which is facing to the first projection in the through-hole, the second projection being sifting from the first projection in the perpendicular direction, wherein the distance between the first projection and the second projection is larger than a plate thickness of the connecting member.

14. An image forming apparatus comprising:

an image forming unit which forms an image on a sheet;

the metal frame of an image forming apparatus according to claim 9; and an outer cover which covers the metal frame of an image forming apparatus.

* * * * *